US010914136B2

(12) United States Patent
Reed

(10) Patent No.: US 10,914,136 B2
(45) Date of Patent: Feb. 9, 2021

(54) SAND FALL-BACK PREVENTION TOOLS

(71) Applicant: Halliburton Energy Services, Inc., Houston, TX (US)

(72) Inventor: Stewart Darold Reed, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 49 days.

(21) Appl. No.: 16/084,130

(22) PCT Filed: Sep. 11, 2017

(86) PCT No.: PCT/US2017/051031
§ 371 (c)(1),
(2) Date: Sep. 11, 2018

(87) PCT Pub. No.: WO2018/052857
PCT Pub. Date: Mar. 22, 2018

(65) Prior Publication Data

US 2020/0291744 A1 Sep. 17, 2020

Related U.S. Application Data

(63) Continuation-in-part of application No. PCT/US2017/012025, filed on Jan. 3, 2017, and a (Continued)

(51) Int. Cl.
*E21B 34/08* (2006.01)
*E21B 43/12* (2006.01)
(Continued)

(52) U.S. Cl.
CPC ..... *E21B 34/08* (2013.01); *E21B 21/103* (2013.01); *E21B 34/066* (2013.01); *E21B 43/128* (2013.01)

(58) Field of Classification Search
CPC ..... E21B 34/08; E21B 43/128
See application file for complete search history.

(56) References Cited

U.S. PATENT DOCUMENTS 3,967,679 A 7/1976 Liljestrand
4,817,739 A 4/1989 Jeter
(Continued)

OTHER PUBLICATIONS

International Search Report, issued in PCT/US2017/051031, dated Dec. 22, 2017.
(Continued)

*Primary Examiner* — D. Andrews
(74) *Attorney, Agent, or Firm* — Locke Lord LLP

(57) ABSTRACT

A downhole tool for sand fall-back prevention can include a sand bridge inducer configured to be mounted in a flow path through a housing in a downhole tool. The sand bridge inducer can define a longitudinal axis and having a main opening therethrough, wherein the sand bridge inducer includes one or more angled passageways defined through a wall of the sand bridge inducer that are oblique relative to the longitudinal axis. The sand bridge inducer can be segmented with a respective upper segment and lower segment at each respective one of the one or more angled passageways, wherein the respective upper and lower segments are connected to one another across the respective angled passageway for movement along the longitudinal axis relative to one another to enlarge the respective angled passageway for accommodating passage of larger particles and/or relieving pressure differentials caused by high flow rates and/or solids restricting flow.

18 Claims, 18 Drawing Sheets

Related U.S. Application Data continuation-in-part of application No. PCT/US2016/051461, filed on Sep. 13, 2016.

(51) Int. Cl.
*E21B 21/10* (2006.01)
*E21B 34/06* (2006.01)

(56) References Cited

U.S. PATENT DOCUMENTS

| | | | |
|---|---|---|---|
| 6,167,969 | B1 | 1/2001 | Schoeffler |
| 6,543,532 | B2 | 4/2003 | Estep et al. |
| 7,487,831 | B2 | 2/2009 | Pluchek et al. |
| 10,082,014 | B2 * | 9/2018 | Fielder, III ..... E21B 43/38 |
| 2005/0230120 | A1 | 10/2005 | Victor |
| 2013/0264069 | A1 | 10/2013 | Williamson, Jr. |
| 2013/0299181 | A1 | 11/2013 | Coyle et al. |
| 2013/0299200 | A1 | 11/2013 | Hughes et al. |
| 2015/0300136 | A1 | 10/2015 | Jefferies et al. |

OTHER PUBLICATIONS

International Search Report issued in PCT/US2017/012025, dated Jun. 2, 2017.
International Search Report issued in PCT/US2016/051461 dated May 10, 2017.

* cited by examiner

SAND FALL-BACK PREVENTION TOOLS

CROSS REFERENCE TO RELATED APPLICATIONS

This application is a 35 U.S.C. § 371 National Phase Application of International PCT Patent Application No. PCT/US2017/051031, filed Sep. 11, 2017, which application is a continuation-in-part of International PCT Patent Application No. PCT/US2017/012025, filed Jan. 3, 2017. International PCT Patent Application No. PCT/US2017/051031 is also a continuation-in-part of International PCT Patent Application No. PCT/US2016/051461, filed Sep. 13, 2016. The entire contents of these applications are incorporated herein by reference in their entirety.

BACKGROUND OF THE INVENTION

1. Field of the Invention

The present disclosure relates to downhole tools, and more particularly to tools for reduction of inoperability and/or damage of electrical submersible pumps due to solid particle (e.g., formation sand, proppant, and the like) fall back such as used in oil and gas wells.

2. Description of Related Art

Natural formation sands and/or hydraulic fracturing proppant (referred to herein as sand) in subterranean oil and gas wells can cause significant problems for electrical submersible pumps (ESPs). Once sand is produced through the ESP it must pass through the tubing string prior to reaching the surface. Sand particles often hover or resist further downstream movement in the fluid stream above the ESP or move at a much slower velocity than the well fluid due to physical and hydrodynamic effects. When the ESP is unpowered, fluid and anything else in the tubing string above the pump begins to flow back through the pump. Check valves are often used to prevent flow back while also maintaining a static fluid column in the production tubing. However check valves are subject to failures caused by solids including sand.

Such conventional methods and systems have generally been considered satisfactory for their intended purpose. However, there is still a need in the art for improved sand fall-back prevention/mitigation tools that protect the operability and reliability of ESPs. The present disclosure provides a solution for this need.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein:

FIG. 17 is a side elevation view of the sand bridge inducer of FIG. 16, showing the angled passageways widened for accommodating a pressure differentials and/or passage of larger particles or solids or the like;

DETAILED DESCRIPTION OF THE PREFERRED EMBODIMENTS

Figure 1:
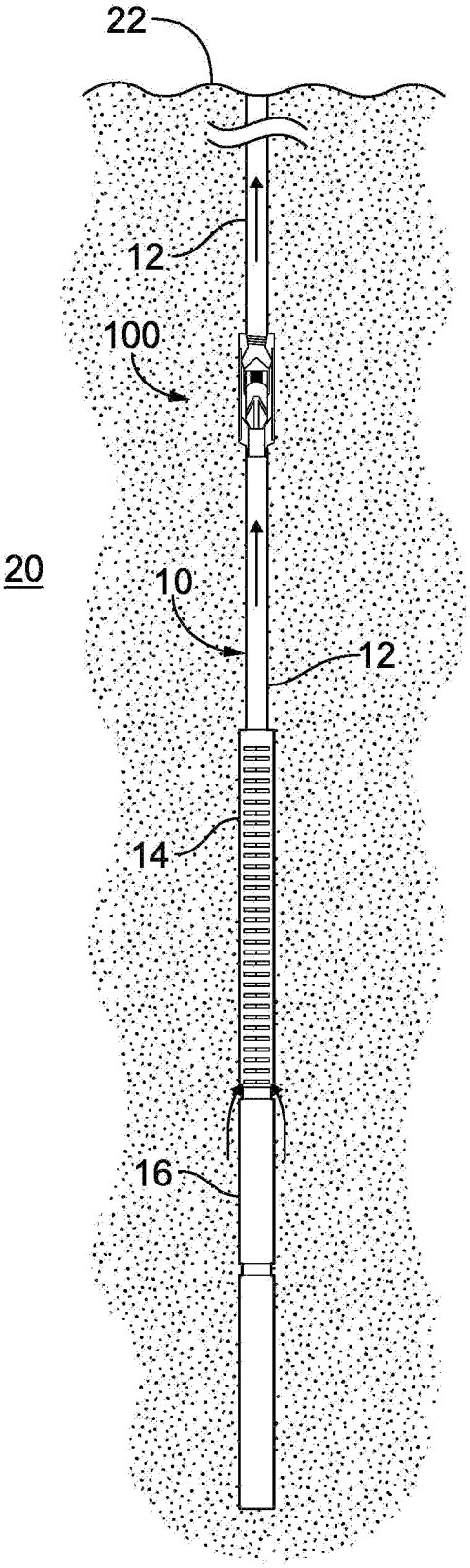
FIG. 1 is a schematic side elevation view of an exemplary embodiment of a downhole tool constructed in accordance with the present disclosure, showing the downhole tool in a string that includes a motor and electrical submersible pump (ESP), wherein the string is in a formation for production of well fluids that may contain any combination of water, hydrocarbons, and minerals that naturally occur in oil and gas producing wells.

Reference will now be made to the drawings wherein like reference numerals identify similar structural features or aspects of the subject disclosure. For purposes of explanation and illustration, and not limitation, a partial view of an exemplary embodiment of a downhole tool in accordance with the disclosure is shown in FIG. 1 and is designated generally by reference character 100. Other embodiments of downhole tools in accordance with the disclosure, or aspects thereof, are provided in FIGS. 2-25, as will be described. The systems and methods described herein can be used to mitigate, reduce or prevent fall-back sand reaching an electrical submersible pumps (ESP) in downhole operations such as in oil, gas, and/or water producing wells.

Figure 2:
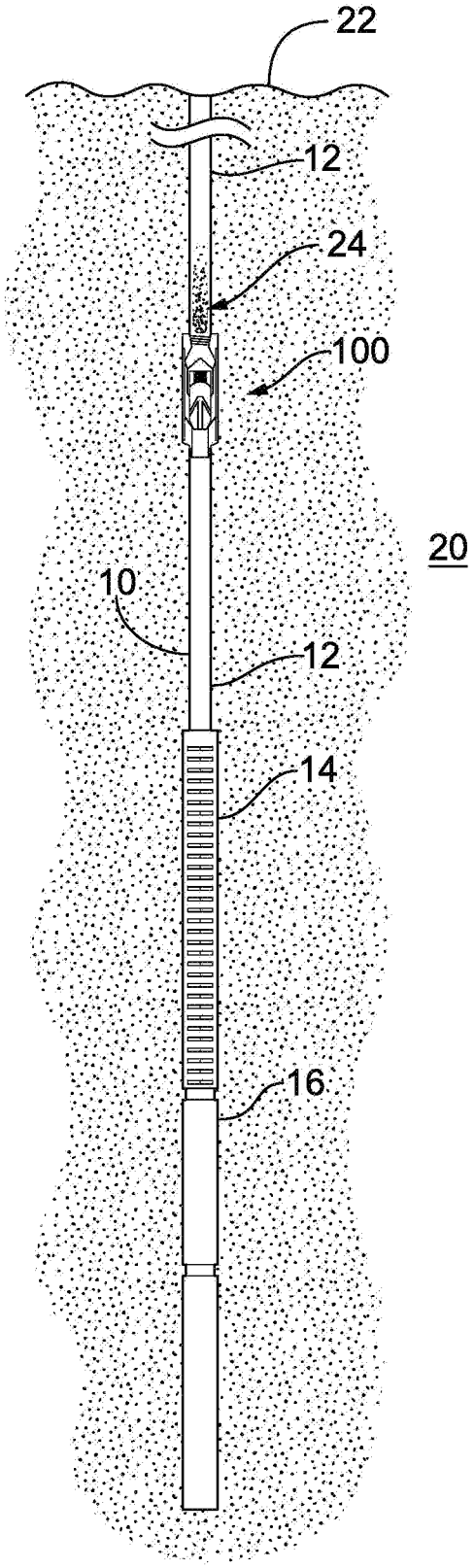
FIG. 2 is a schematic side elevation view of the downhole tool of FIG. 1, showing the tool preventing/mitigating fall-back sand from reaching the ESP during shutdown of the ESP.

String 10 includes production tubing 12, downhole tool 100, ESP 14, protector 16, and motor for driving ESP 14. These components are strung together in a formation for production, e.g., of oil, gas and/or water, from within formation 20. In FIG. 1, the flow arrows indicate operation of ESP 14 to receive fluids in from formation 20 then drive through production tubing 12 and downhole tool 100 to the surface 22. As shown in FIG. 2, when ESP 14 stops pumping, fall-back sand 24 in the production tubing 12 above downhole tool 100 recedes toward the ESP 14, but is mitigated or prevented from reaching ESP 14 by downhole tool 100.

Figure 3:
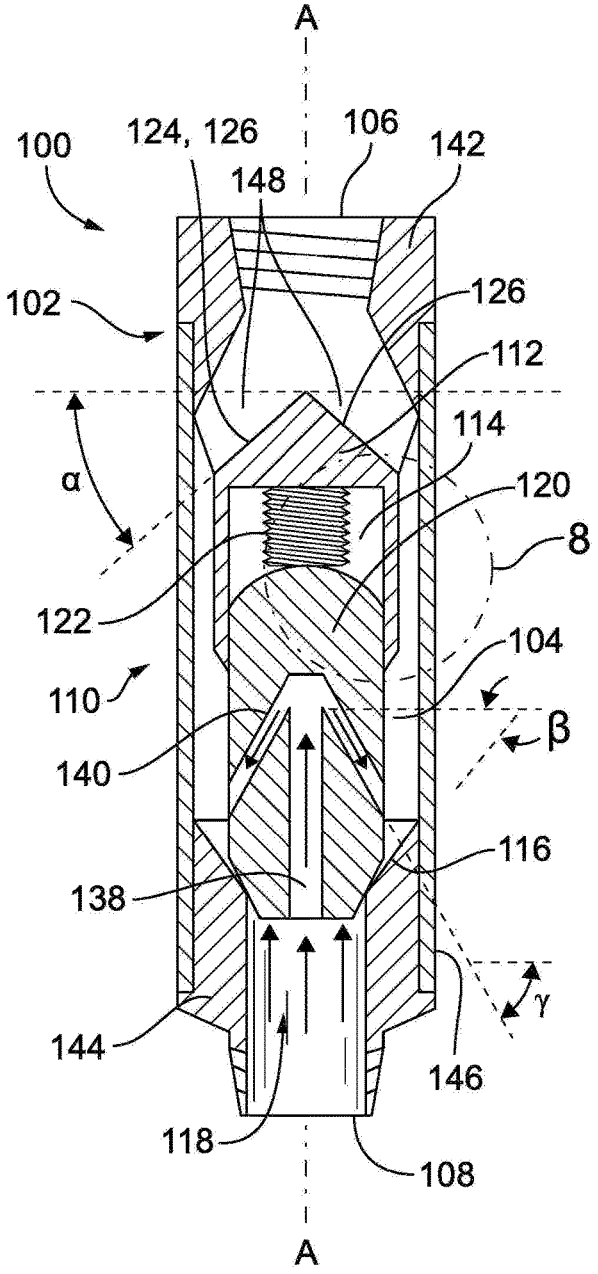
FIG. 3 is a schematic cross-sectional elevation view of the downhole tool of FIG. 1, showing the valve poppet in the closed position with flow arrows indicating the flow during opening of the poppet valve and just prior to establishment of a full flow condition.

With reference now to FIG. 3, downhole tool 100 is configured for sand fall-back prevention/prevention as described above. Downhole tool 100 includes a housing 102 defining a flow path 104 therethrough in an axial direction, e.g. generally along axis A, from an upper opening 106 to a lower opening 108. Depending on the direction of flow, upper opening 106 may be an inlet or an outlet, and the same can be said for lower opening 108. Those skilled in the art will readily appreciate that while axis A is oriented vertically, and while upper and lower openings 106 and 108 are designated as upper and lower as oriented in FIGS. 3-7 and FIGS. 13-15, other orientations are possible including horizontal or oblique angles for axis A, and that the upper opening 106 need not necessarily be above lower opening 108 with respect to the direction of gravity. Upper opening 106 is closer than lower opening 108 in terms of flow reaching surface 22, shown in FIG. 1, regardless of the orientation of downhole tool 100.

A poppet valve 110 is mounted within the housing. The poppet valve 110 includes an upper member 112 defining an upper chamber 114 mounted in the flow path 104 so that flow through the flow path 104 flows around the upper member 112. A valve seat 116 is mounted in the flow path 104 with an opening 118 therethrough. A valve poppet 120 is mounted for longitudinal movement, e.g., in the direction of axis A, within the flow path 104 between a closed position, shown in FIG. 3, in which the valve poppet 120 seats against the valve seat 116 to block flow through the flow path 104, and an open position, shown in FIG. 4, in which the valve poppet 120 is spaced apart from the valve seat 116 to permit flow through the flow path 104.

Figure 4:
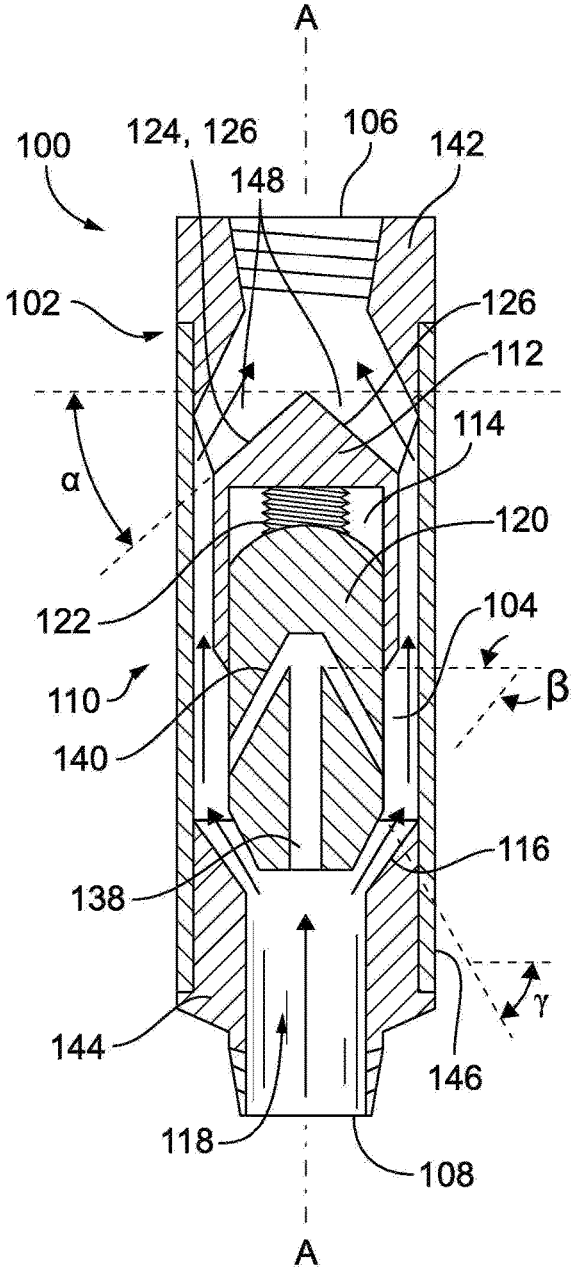
FIG. 4 is a schematic cross-sectional elevation view of the downhole tool of FIG. 1, showing the valve poppet in the open position, flowing as during production with a full flow condition.

In both the open and closed positions, as shown in FIGS. 4 and 3, respectively, the valve poppet 120 remains at least partially within the upper chamber 114 so that the upper chamber 114 is always enclosed to prevent/mitigate accumulation of fall-back sand above the valve poppet 120. A biasing member 122 is seated in the upper chamber 114 biasing the valve poppet 120 toward the valve seat 116. The biasing member can be configured to provide either an opening or closing force sized/calibrated with respect to fluid properties, slurry characteristics and flow conditions for moving the valve poppet 120 from the open/closed position to the closed/opened position. Biasing member 122 may be used to eliminate the need for gravitational forces assisting valve closure, e.g., in horizontal or deviated wells.

The upper member 112 includes an upper surface 124 with at least one angled portion 126 that is angled, e.g. at angle $\alpha$ below the level dashed line in FIG. 3, to resist accumulation of sand on the upper surface. For example angle $\alpha$ can be greater than the angle of repose, e.g. 45° of the fall-back sand and/or debris expected to be present in downhole tool 100.

Figure 8:
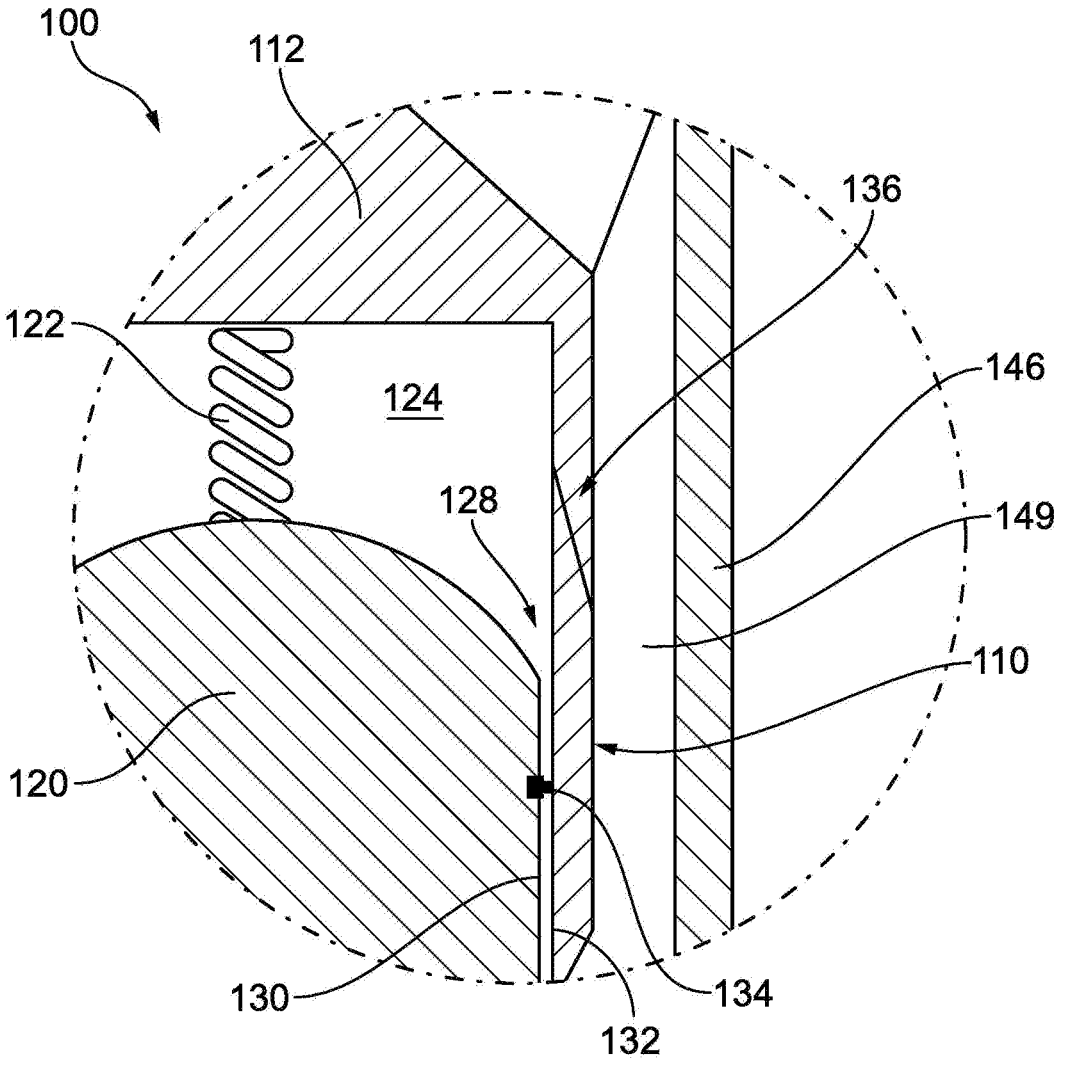
FIG. 8 is a schematic cross-sectional elevation view of a portion of the downhole tool of FIG. 1, showing the weep hole and wiper seal features of the valve that assist in enabling and protecting the upper movement of the valve's poppet.
Figure 9:
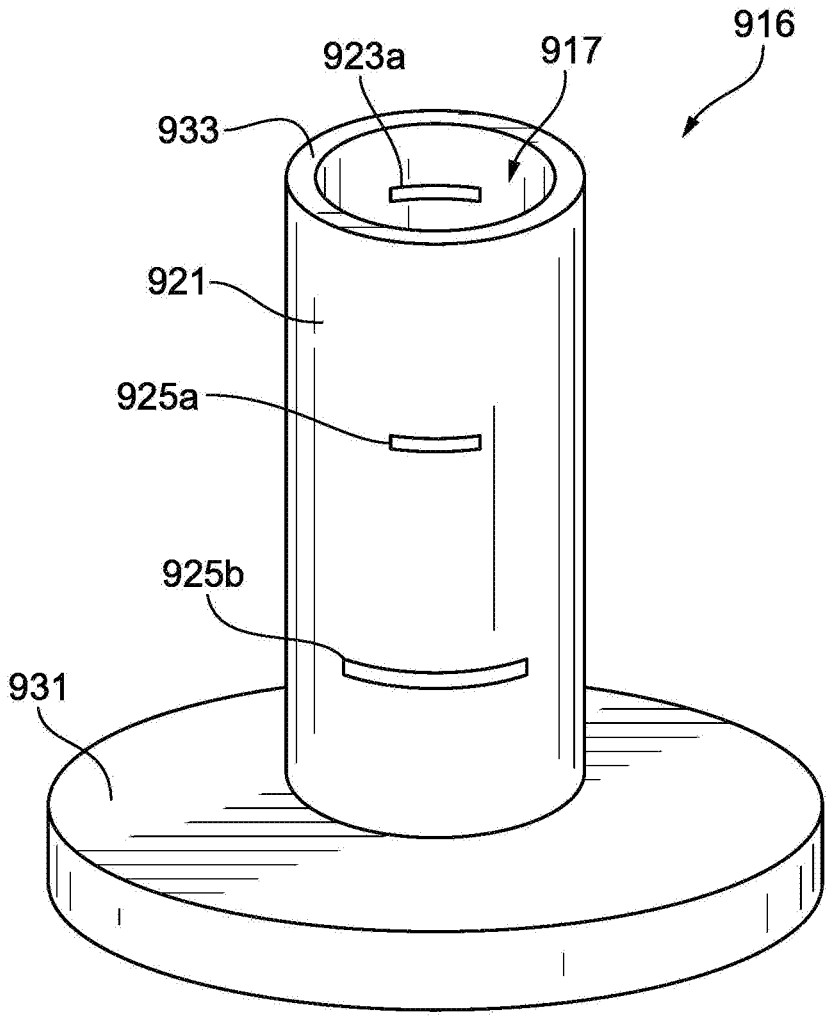
FIG. 9 is a perspective view of an embodiment of a sand bridge inducer in accordance with this disclosure, showing embodiments of radially outward openings of upwardly angled passageways defined through a wall of the inducer.
Figure 10:
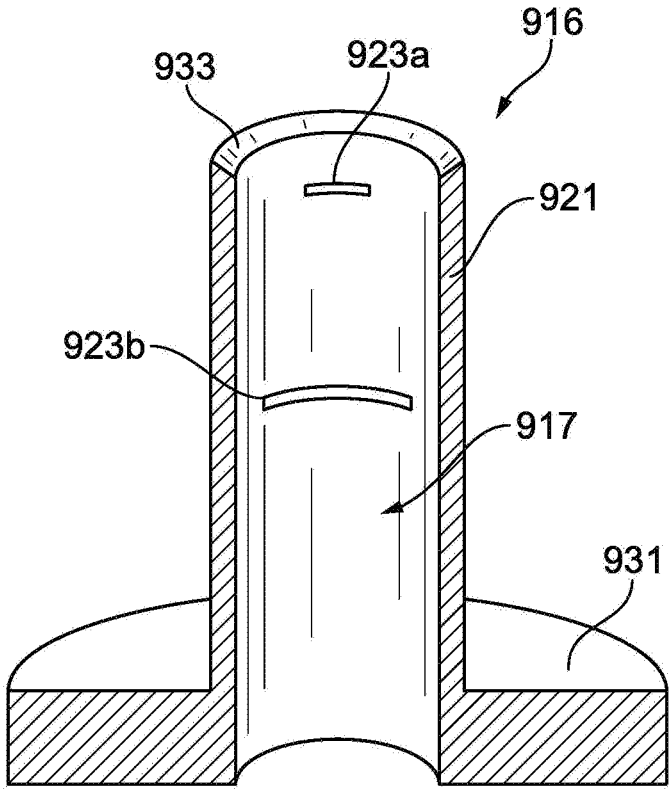
FIG. 10 is a perspective cross-sectional view of the embodiment of FIG. 9, showing embodiments of radially inward openings of upwardly angled passageways defined through a wall of the inducer.

As shown in FIG. 8, the valve poppet 120 is narrower than the upper chamber 124, and there is therefore a gap 128 to allow movement of the valve poppet 120 without resistance from fall-back sand or debris. Valve poppet 120 includes an axially oriented perimeter surface 130 matched in shape, e.g., cylindrical, with an axially oriented interior surface 132 of the upper chamber 124. A wiper seal 134 engages between the valve poppet 120 and the upper member. The wiper seal 134 may be configured to allow passage of fluid while inhibiting passage of sand or debris, to keep upper chamber 124 and gap 128 clear of sand or debris. While only one wiper seal 134 is shown, those skilled in the art will readily appreciate that any suitable number of wiper seals can be used, or other sealing mechanisms may be employed to achieve the same result of restricting debris passage while allowing liquid to seep across the sealing interface. A weep hole 136 can be defined through the upper member 112 from a space outside the upper chamber 124 to a space inside the upper chamber 124. The weep hole 136 is configured to equalize pressure between the flow space outside the upper chamber 124 with the cavity inside the upper chamber 124. A filter material can be included within the weep hole 136 to assist with preventing sand/debris from entering the upper chamber 124. Upper chamber 124 can be lengthened to any suitable length along valve poppet 120 for a given application, as the length helps prevent debris migration into upper chamber 124.

With reference again to FIG. 4, the valve seat 116 is defined by an angular surface, angled at angle $\beta$ below horizontal as oriented in FIG. 4. This encourages wedging of sand during closing of the valve poppet 120 against the valve seat 116. The angle $\beta$ also serves to limit restrictive forces while opening the poppet valve 110. A poppet channel 138 is defined through the valve poppet 120 for limited fluid communication through the flow path 104 with the valve poppet 120 in the closed position. The poppet channel 138 can have a flow area equal to one-half of that through the flow path 104 with poppet valve 120 in the open position, or greater. The poppet channel 138 can include one or more tributaries 140, each with an opening on the peripheral surface 130 of the poppet valve 120. Each of the tributaries 140 of the poppet channel 138 is directed downward toward the valve seat 116 for initiating a buoyancy change in sand seated between the valve seat 116 and the valve poppet 120 prior to the valve poppet 120 moving from the closed position to the open position. This type of flow is indicated in FIG. 3 with flow arrows. Each tributary 140 of the poppet channel can be defined along a tributary axis angled downward equal to an angle γ, e.g., or more than 45° from level. This angle γ mitigates sand migrating upward through the channel tributary 140. Housing 102 includes a head 142 including the upper member 112 and upper opening 106. When excessive sand is present, the angle γ and small channel diameter can prevent a constant flow of sand slurry in the reverse direction thereby creating a plug effect.

Housing 102 also includes a base 144 including the lower opening 108 and the valve seat 116. Housing 102 further includes a housing body 146 mounted to the head 142 and base 144, spacing the head 142 and base 144 apart axially. Flow path 104 includes upper opening 106, passages 148 through head 142, the space 149 between housing body 146 and poppet valve 110 (as shown in FIG. 8), the space between valve poppet 120 and valve seat 106, opening 118 through valve seat 116, and lower opening 108. Head 142 and base 144 can include standard external upset end (EUE) connections for ease of installation of downhole tool 100 in a production tubing string above an ESP. Multiple downhole tools 100 can be strung together for cumulative effect and redundancy. Surfaces of head 142 may be coated or hardened to help mitigate erosion. The flow area can be slightly larger than the passageway of an ESP pump head with shaft coupling installed. Tool 100 may have multiple sizes to reflect a like ESP pump head passage way with shaft coupling installed.

Figure 5:
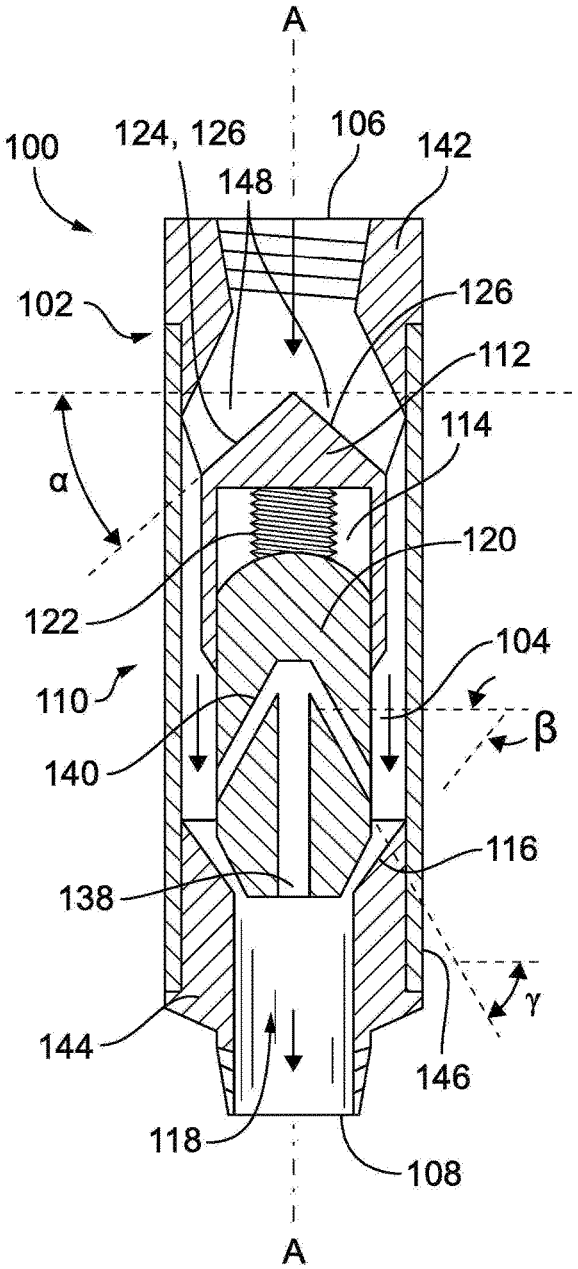
FIG. 5 is a schematic cross-sectional elevation view of the downhole tool of FIG. 1, showing the valve poppet closing immediately after powering down the ESP thereby inducing a reverse flow condition in the production tubing and valve.
Figure 6:
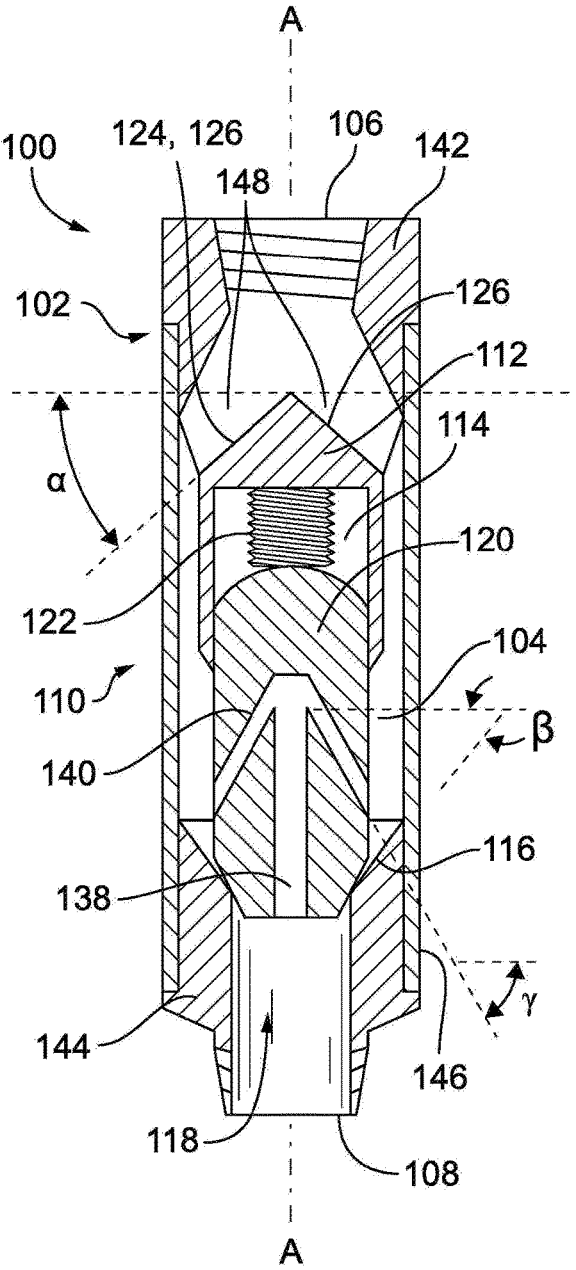
FIG. 6 is a schematic cross-sectional elevation view of the downhole tool of FIG. 1, showing the valve poppet in the closed position restricting/mitigating sand fall-back toward the ESP.

A method of reducing fall-back sand reaching an electrical submersible pump (ESP) includes holding a valve poppet, e.g., valve poppet 120, in an open position by operating an ESP, e.g., ESP 14, to drive flow through a flow path, e.g. flow path 114, past the valve poppet, as shown in FIG. 4, where the flow arrows indicate flow with the valve poppet in an open and flowing position. The method also includes moving the valve poppet into a closed position blocking the flow path by reducing flow from the ESP. FIG. 5 shows the valve poppet 120 moving to the closed position, wherein the flow arrows indicate back flow during shut down of ESP 14. In the closed position of poppet valve 120, shown in FIG. 6, valve poppet 120 restricts sand at the valve seat interface, thereby causing sand accumulation alongside the valve poppet 120, within the tributaries 140 and throughout the normal downstream flow path(s) of flow path 104, passages 148, and upper opening 106 while the valve poppet is in the closed position. In the closed position, back flow can be allowed thorough a poppet channel, e.g., poppet channel 138, defined through the valve poppet. This can allow for flow of chemical treatments for ESP from the surface during shutdown, for example.

Figure 7:
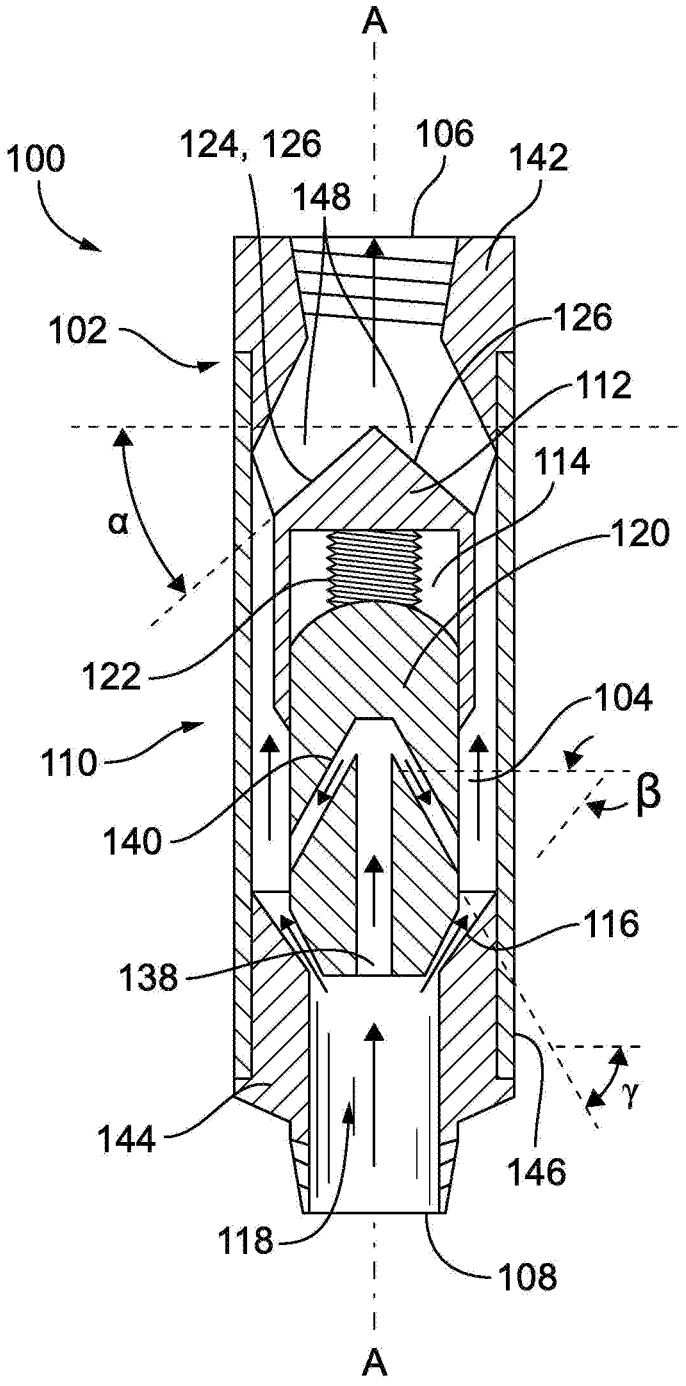
FIG. 7 is a schematic cross-sectional elevation view of the downhole tool of FIG. 1, showing the valve poppet re-opening while sand is restrained above the lower opening of the downhole tool.

Referring now to FIG. 3, initiating movement of the valve poppet from the closed position to an open position can be done by directing flow through a tributary, e.g. tributary 140, of the poppet channel defined through the valve poppet. This flow through the tributary is directed at sand accumulated between the valve poppet and an adjacent valve seat, e.g. valve seat 116. Thereafter, as ESP increases the flow pressure, the valve poppet overcomes the biasing member, e.g., biasing member 122, to move to the open position as shown in FIG. 7. This discharges accumulated fall-back sand from a tool, e.g., downhole tool 100, in an upward direction toward the surface 22 as indicated by the flow arrows in FIG. 7.

Referring additionally to FIGS. 9-12, various views of an embodiment of a sand bridge inducer 916 for a downhole tool are shown. The sand bridge inducer 916 includes one or more angled passageways 919*a*, 919*b* defined through a wall 921 of the sand bridge inducer valve seat 916. The one or more angled passageways 919*a*, 919*b* open from a radially inward opening 923*a*, 923*b* and traverse axially downward through the wall 921 of the sand bridge inducer valve seat 916 toward a radially outward opening 925*a*, 925*b*. For example, in certain embodiments, the radially inward opening 923*a*, 923*b* can be axially above the radially outward opening 925*a*, 925*b* as oriented in FIGS. 11A, 11B, and 12. Any other suitable relative arrangement is contemplated herein.

In certain embodiments, the one or more angled passageways 919*a*, 919*b* can include one or more linear passageways defined between a respective radially inward opening 923*a*, 923*b* and radially outward opening 925*a*, 925*b*. In certain embodiments, as shown, the passageways 919*a*, 919*b* can have a uniform cross-sectional flow area between the radially inward opening 923*a*, 923*b* and radially outward opening 925*a*, 925*b*. It is contemplated that non-uniform cross-sectional areas (e.g., reducing or expanding, tapered) can be utilized. The angled passageways 919*a*, 919*b* can be and/or include any other suitable flow path (e.g., non-linear, having concave or convex curved features as part of or making the entire length of the upward flow path, having end connected linear segments creating a progressing or digressing upward flow angle) within the wall 921 of the sand bridge inducer 916 between the radially inward opening 923*a*, 923*b* and the radially outward opening 925*a*, 925*b*.

Figure 11A:
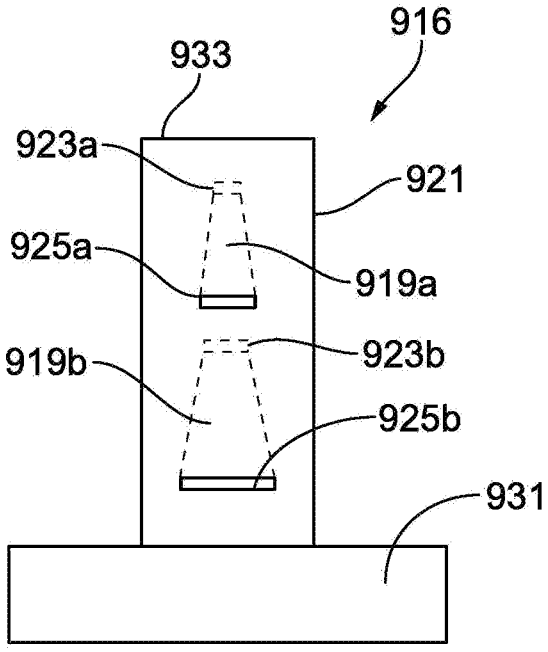
FIG. 11A is a side view of the embodiment of FIG. 9, schematically showing embodiments of upwardly angled passageways in phantom defined through a wall thereof.
Figure 11B:
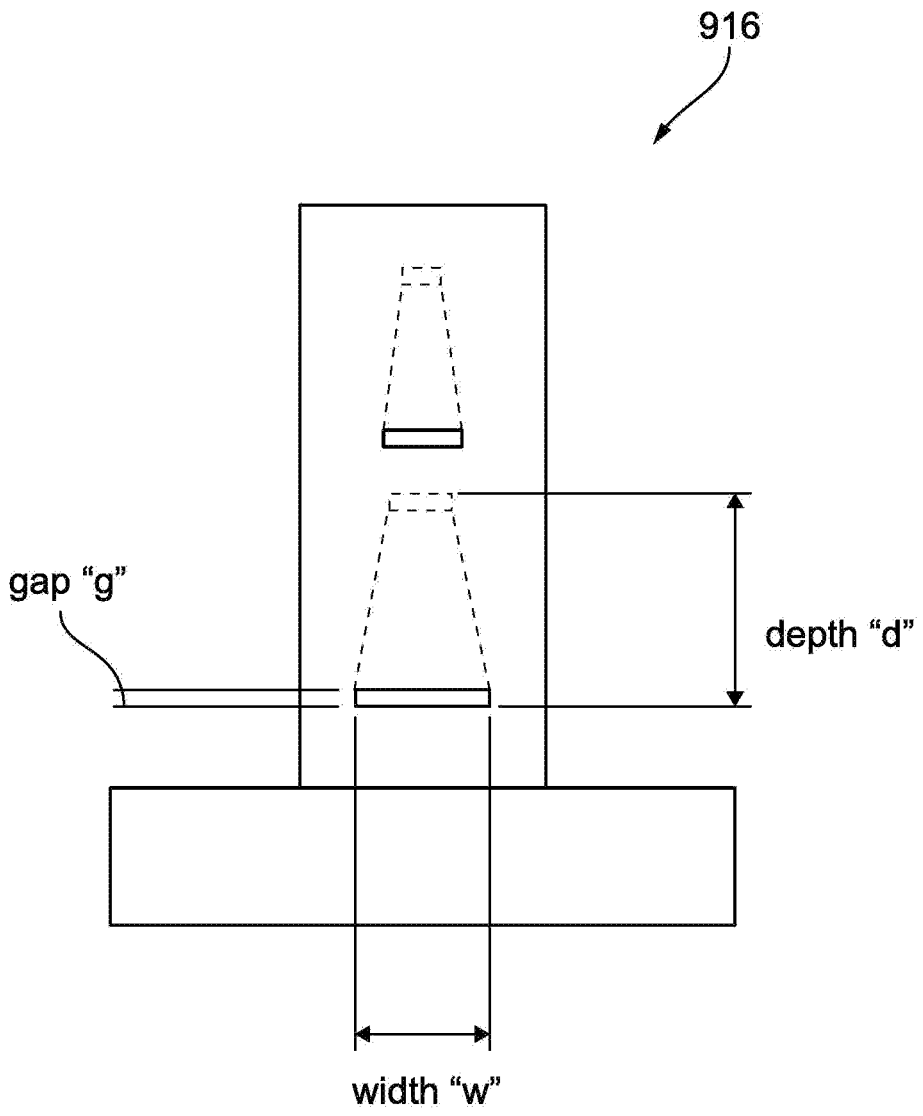
FIG. 11B is a side view of the embodiment of FIG. 9, schematically showing embodiments of upwardly angled passageways in phantom defined through a wall thereof, indicating dimensions as described herein.

In certain embodiments, the one or more angled passageways 919*a*, 919*b* can include one or more plate flow passageways including a rectangular cross-section (e.g., as shown in FIG. 11A). Any other suitable cross-sectional shape (e.g., elliptical, square, round) is contemplated herein. In certain embodiments, the cross-sectional area of the one or more plate flow passageways can include any suitable (e.g., 10:1) width "w" to gap "g" ratio (e.g., as shown in FIG. 11B), for example. Any other aspect ratio is contemplated herein.

Figure 12:
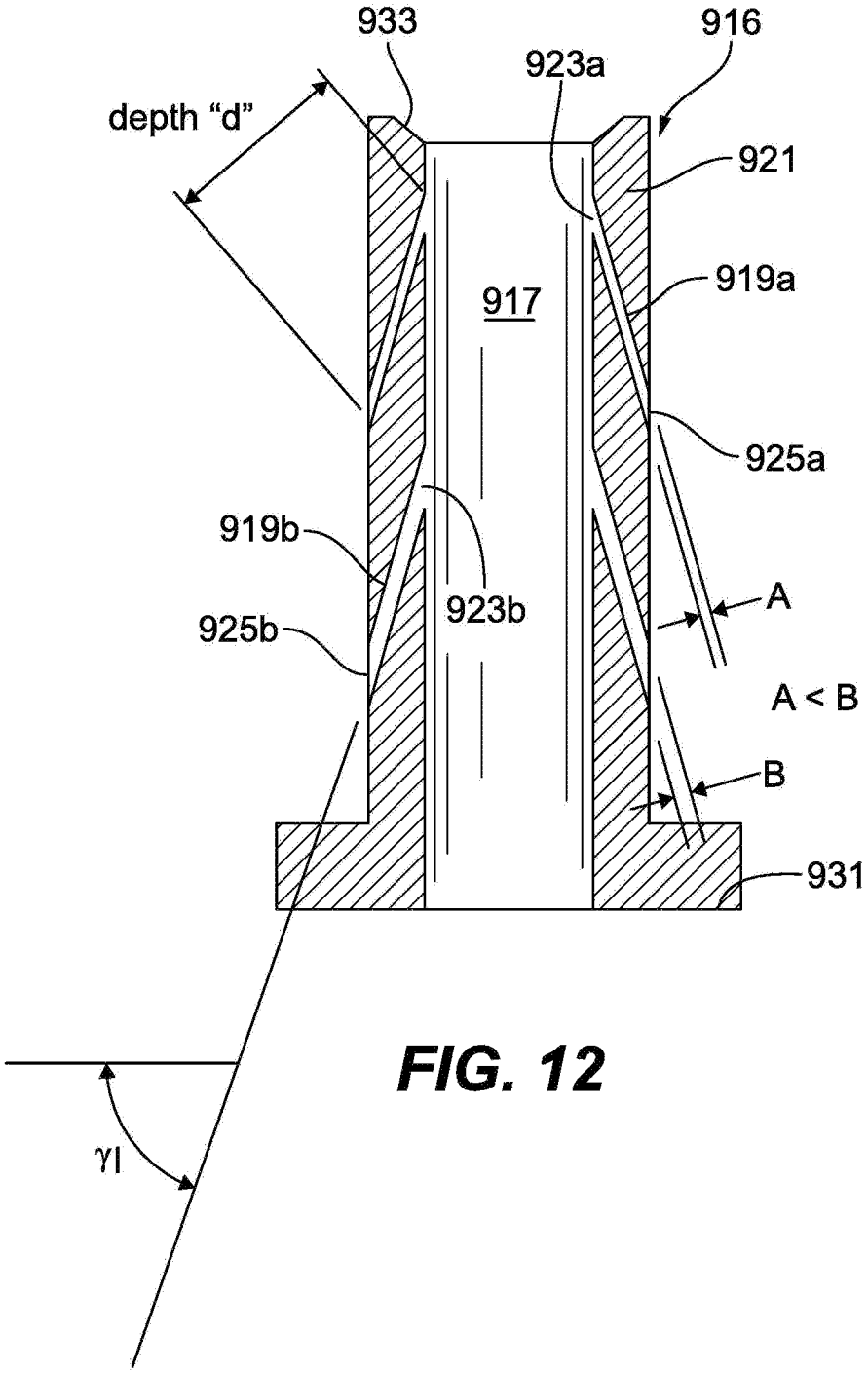
FIG. 12 is a cross-sectional view of the embodiment of FIG. 9.
Figure 13:
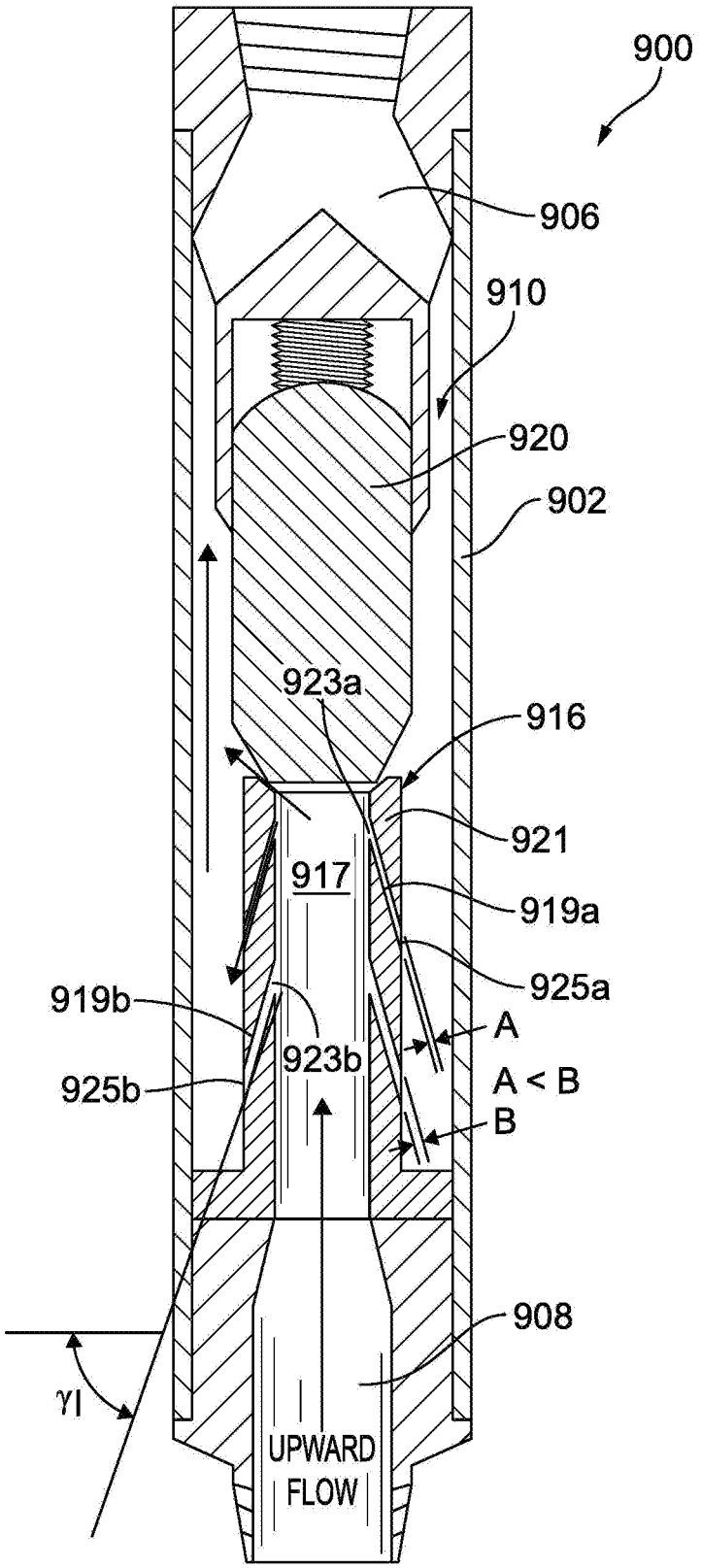
FIG. 13 is a cross-sectional view of an embodiment of a downhole tool in accordance with this disclosure, shown in an upflow condition.
Figure 14:
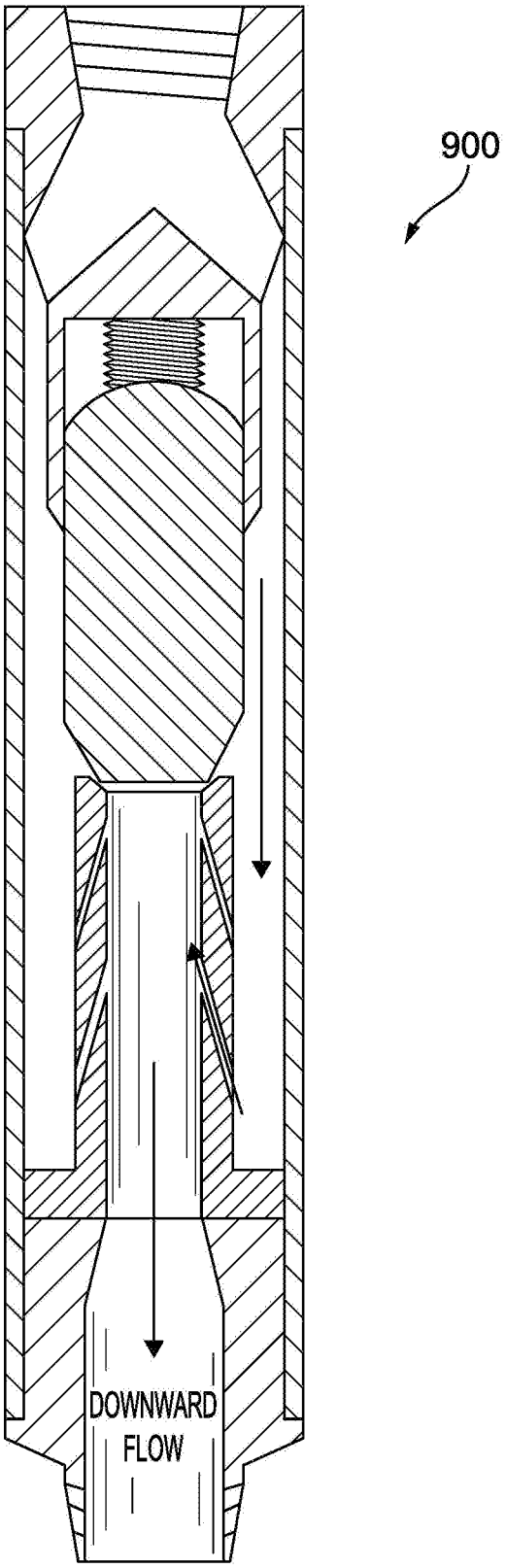
FIG. 14 is a cross-sectional view of the embodiment of FIG. 13, shown in a downflow condition.

In certain embodiments, as shown, the gap dimension "g" can be vertical or aligned to the axial direction/axial flow path (e.g., as shown in FIG. 11B). It is also contemplated that the gap dimension "g" can be the distance (e.g., the shortest distance) between the interior walls of the angled passageways, irrespective of axial relation (e.g., orthogonal to flow direction). As shown in FIGS. 12 and 13, the gap "g" is represented by two gap dimensions "A" and "B" indicating differing sizes in the embodiment shown. As described herein, the term gap dimension "g" is generic to any and all suitable gap dimensions as appreciated by those having ordinary skill in the art and shown in the various figures (e.g., "g" as shown in FIG. 11B, "A" and/or "B" as shown in FIGS. 12-14). The width dimension "w" can be horizontal or orthogonal to the axial direction/axial flow path.

The at least one of the angled passageways 919*a*, 919*b* can include an angle $\gamma_f$ of 45 degrees or higher between the radially inward opening 923*a*, 923*b* and radially outward opening 925*a*, 925*b*. Any other suitable angle is contemplated herein.

The angled passageways 919*a*, 919*b* can be cut at a severe angle $\gamma_I$ for at least two reasons. First, an aggressive angle, e.g., greater than the angle of repose for the material such as sand that is desired to be blocked from back flow, can hinder sand from flowing upward through the passageways 919*a*, 919*b*. Second, the angled orientation allows for a longer passageway 919*a* in the depth dimension "d" (e.g., as shown in FIGS. 11B and 12), 919*b*, given the wall thickness of inducer 906 into which the passageways are formed, thereby forming a "plate" like flow path geometry. For example, the depth "d" of the passageway relative to the gap dimension "g" (which can include dimensions "A" and/or "B" for example) may be a 20:1 ratio (e.g., 1 inch depth "d" for a 0.05 inch gap). Any other suitable ratio showing a substantial depth to gap geometry is contemplated herein.

At least one of the one or more angled passageways 919*a*, 919*b* can be sized to promote a sand bridging effect therein without allowing sand to travel into the main opening 917. The one or more angled passageways 919*a*, 919*b* can include at least two passageways of different flow area. For example, as shown in FIGS. 12-14, a first passageway 919*a* of the at least two passageways can have a smaller flow area and/or smaller gap dimension "A" than a second passageway 919*b* gap dimension "B". Also as shown, the first passageway 919*a* can be disposed axially upward of the second passageway 919*b*. In certain embodiments, the first passageway 919*a* can include a smaller gap dimension but the same flow area as the second passageway 919*b* (e.g., the first passageway 919*a* can be wider but narrower).

In certain embodiments, the first passageway 919*a* includes a gap "A" and a flow area that is smaller than the second passageway 919*b*. The smaller gap of the first passageway 919*a* can be sized to not require leak-off to induce a sand bridge in the first passageway 919*a* path, whereas the larger gap of the second passageways 919*b* can require higher sand concentrations to have an effective sand bridge.

In certain embodiments, the smaller first passageway 919*a* can be sized to allow leak-off during downflow, e.g., such that mostly or only liquid will be removed from the slurry flow by way of the first passageway 919*a*. Path 919*a* leaks off fluid upstream of 919*b* thereby causing a higher concentration of sand particles present at the opening of 919*b*. The higher concentration of sand particles promotes sand bridging in 919*b*, e.g., when 919*b* has been configured with a gap dimension larger than 919*a*. The larger second passageway 919*b* can be designed to allow sand bridging therein such that sand (and/or other sediment or solid particulate) can collect in the second passageway 919*b* without being able to flow into the main opening 917.

The sand bridge inducer 916 can include a top hat shape or any other suitable shape. For example, as shown, the sand bridge inducer 916 can include a mounting flange 931, e.g., for mounting in a tool housing such that flow must flow through the main opening (e.g., via the angled passageways 919*a*, 919*b*). In certain embodiments, the sand bridge inducer 916 can include an interface 933 at a top (axially upward) portion thereof, e.g., for acting as a valve seat for sealing interaction between a poppet and the sand bridge inducer 916. In certain embodiments, it is contemplated that the top portion of the sand bridge inducer 916 can be sealed in any suitable manner.

If the main opening 917 is sealed at the top (e.g., from a cap, from design, from a poppet blocking the main opening 917), flow will have to pass through the angled passageways 919*a*, 919*b* to flow into the main opening 917. In this regard, the upward angled passageways 919*a*, 919*b* are sized, shaped, angled, and/or otherwise designed to allow liquid to travel through the one or more angled passageways 919*a*, 919*b* without allowing sand and/or other sediment/solid particulate from entering the main opening 917. In upward flow, sand is allowed to go through the passageways 919*a*, 919*b*, e.g. when upward flow sand concentrations are less than 0.1% by volume, or through 917 if the poppet 920 opens. The poppet will open when plugging occurs, e.g. when sand slugs having a high concentration of sand in the tubing flow occurs during upward flow, or high flow rates are encountered.

Embodiments, of sand bridge inducer 916 can be utilized in a valve assembly, e.g., as a valve seat for example. Referring to FIG. 13, certain embodiments of a downhole tool 900 for sand fall-back prevention can include a housing 902 defining a flow path therethrough in an axial direction from an upper opening 906 to a lower opening 908. The tool 900 includes a poppet valve 910 mounted within the housing 902. The tool 900 and/or poppet valve 910 can be similar as described above and/or any other suitable poppet valve assembly.

As shown in FIG. 13, in certain embodiments, the poppet valve 910 can include a sand bridge inducer 916 as described above used as a valve seat mounted in the flow path with a main opening 917 therethrough. A valve poppet 920 is mounted for longitudinal movement within the flow path between a closed position (e.g., as shown in FIGS. 13-15) in which the valve poppet 920 seats against the sand bridge inducer 916 to block flow through the upper valve seat space of main opening 917 and an open position (e.g., as shown in phantom in FIG. 13) in which the valve poppet is spaced apart from the valve seat to permit flow through the upper valve seat space of main opening 917.

In certain embodiments, as shown, the poppet valve 910 includes a poppet 920 that may be solid and/or does not include any flow passage therethrough, for example. Any other suitable poppet (e.g. having other shapes being solid and/or having flow passages) or assembly is contemplated herein.

Figure 15:
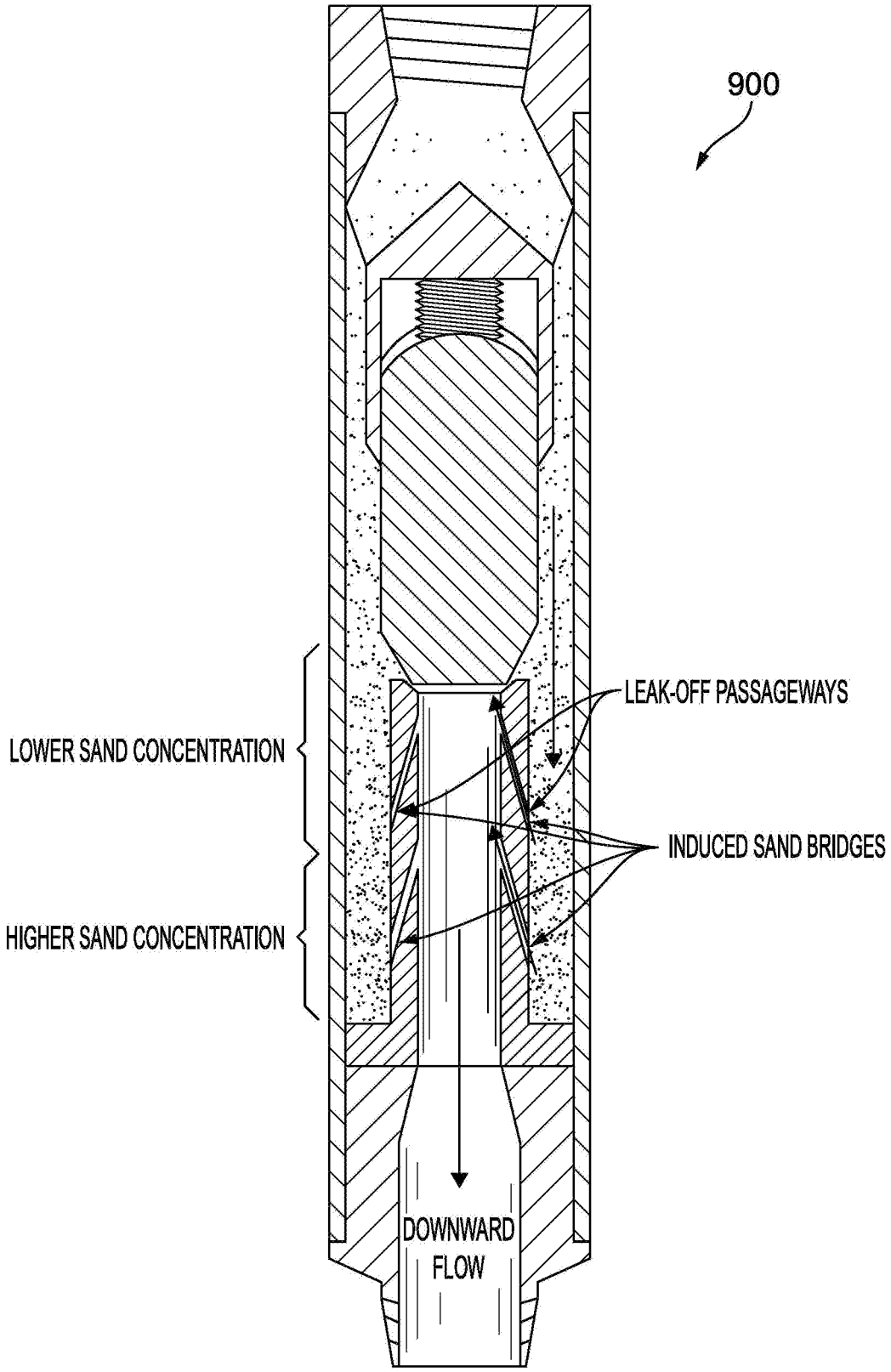
FIG. 15 is a cross-sectional view of the embodiment of FIG. 13, shown in a downflow condition wherein sand is accumulating and/or bridging in the downhole tool.

The sand bridge inducer 916 can be used in any suitable manner within any suitable well system and/or well tool (e.g., used as a valve seat 916 as shown in FIGS. 13-15). It is contemplated herein that the sand bridge inducer 916 need not be utilized as a valve component, can be utilized as a standalone device in any suitable flow path.

FIG. 13 shows the tool 900 in a normal upflow condition (e.g., when a pump is turned on). In this regard, flow travels up through the main opening 917 and through the angled passageways 919*a*, 919*b*, for example. With a flow rate greater than tool 900 designed flow range, sufficient drag force, and/or during periods when inducer 916 is plugged (e.g., from sand or debris) causing a sufficiently high pressure differential, the poppet 920 may be unseated from the sand bridge inducer 916 and allow flow past the poppet 920 (and/or for debris to be flushed therefrom).

Referring to FIG. 14, the tool 900 is shown subjected to downward flow (e.g., soon after turning a pump off). As shown the flow is still mostly liquid. The flow is allowed to pass through the angled passageways 919*a*, 919*b* to enter the main opening 917 to continue along the flow path downward.

Referring to FIG. 15, the tool 900 is shown subjected to a downward flow where sand has fallen back down and accumulated in the tool 900. With a configuration where the smaller passageway 919*a* is disposed above a larger passageway 919*b*, a "leak-off" effect occurs. In this situation, the "leak-off" induces a higher concentration of sand at the lower and larger second passageway 919*b*.

As described above, the angled passageways 919*a*, 919*b* can have small gaps (e.g., high aspect ratios) that are wide thereby allowing for an overall large flow area. The small gap size is sized to promote a sand bridging effect when sand concentrations rise. When sand bridges form in/at all the narrow gap passageways (e.g., passageways 919*a* and/or 919*b*), this effectively impedes sand fall-back.

As described above, embodiments include a valve that includes an upper poppet and a sand bridge inducer. In such embodiments, the poppet does not need to have internal flow paths. Embodiments use the poppet to ensure upward flow by opening when the sand bridge inducer 916 becomes plugged due to sand slug events or short periods of thick debris that has been produced through the ESP pump. When the poppet opens during normal upward flow, any solids or debris attempting to plug the sand bridge inducer at radially inward opening 923*a* and/or 923*b* can be flushed through the tool thereby allowing the tool to return to normal operation.

Embodiments as described above can include narrow yet wide passageways that are cut at aggressive angles into the sand bridge inducer 916. These passageways hydraulically can connect the lower part of the valve with the upper part of the valve. Embodiments can effectively create "plate-flow" (flow between two flat plates) which can promote sand bridging. Yet, because embodiments can also include a wide (horizontal) dimension the overall flow area is enlarged. The increased flow area can aid in reducing localized flow velocities and overall pressure drop across the tool. Reduced flow velocity can also promote sand bridging during downward flow (fall-back) while also reducing erosion during normal upward flow.

Also as described above, certain embodiments include upper passageways that have the narrowest gap while the lowest passageways have the largest gap. When a fall-back event occurs, sand particle and fluid will first reach the small gap passageways. In such embodiments where these passageways are smaller, sand particles are less encouraged to enter the passageway and therefore continue flowing downward toward the large gap passageways. Meanwhile, fluid particles easily flow through the small gap passageways (e.g. 919*a*) thereby causing a "leak-off" effect. Fluid effectively "leaks" from the slurry which can increase the slurry's sand concentration just below the small gap passageways, and prior to the large gap passageway (e.g. 919*b*).

Certain embodiments can have small gap lower passageways that are designed to easily form a sand bridge when sand concentrations are lower, and thus do not require leak-off support. Gap size selection of the angled passageways can be related to the targeted sand particle size. For example, the gap dimension can be designed from one to three times the diameter of the target particle size in certain embodiments. Since leak-off causes an increased sand concentration that promotes sand bridging in the lower yet larger gap passageways, such passageways may be designed anywhere from three to six times the diameter of the target particle size. As sand concentration ranges increase, the gap size may also be increased because an increasing sand concentration also promotes sand bridging.

As described above, utilizing plate-flow geometry with graduated gap sizes allows for an overall effective and efficient means of flow-back while quickly inducing a sand bridge if sand particles are present. If no sand was present, embodiments would cause little flow restriction resulting in a flow-back rate nearly equal to a system not having the tool installed. This can be because of the flow area achieved by cumulating all the angled passageways. The number of angled passageways (and overall tool length) can be minimized using graduated gap sizing.

After a sand bridge has been formed during a fall-back event, the tool then causes fall-back sand to remain in the production tubing above the tool instead of flowing back into/onto the ESP pump. When the ESP pump has been successfully restarted the fluid below the tool is pressurized. This pressure is instantly communicated through the plate-like passageways and to the sand column in and above the tool. Once this occurs, the buoyancy of the sand changes and the sand column begins to re-fluidize. Once the sand column has been re-fluidized sand particles will begin to flow upward toward the surface. After flow has been established the sand that was once bridged in the tool will flow out (and upward) from the tool. If clogging occurs in the sand inducer element passageways at openings 923*a*/923*b* the poppet will open due to the differential pressure established by the pressure just below the poppet seat and the pressure in the upper chamber just above the poppet. When the poppet opens, debris/sand in 917 will clear through the tool and fluidization of the sand column above the tool will be improved and therefore promoting sand production upward and away from the tool.

Figure 16:
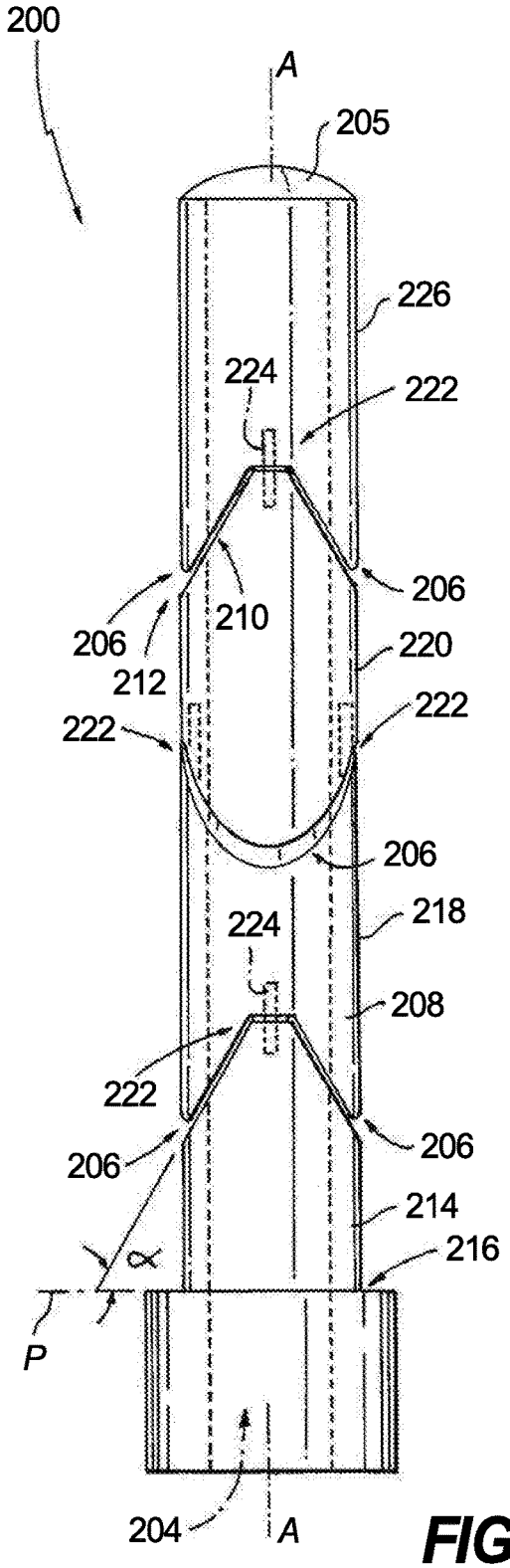
FIG. 16 is a side elevation view of an exemplary embodiment of a sand bridge inducer constructed in accordance with the present disclosure, showing angled passageways for forming sand bridges in downflow conditions.
Figure 23:
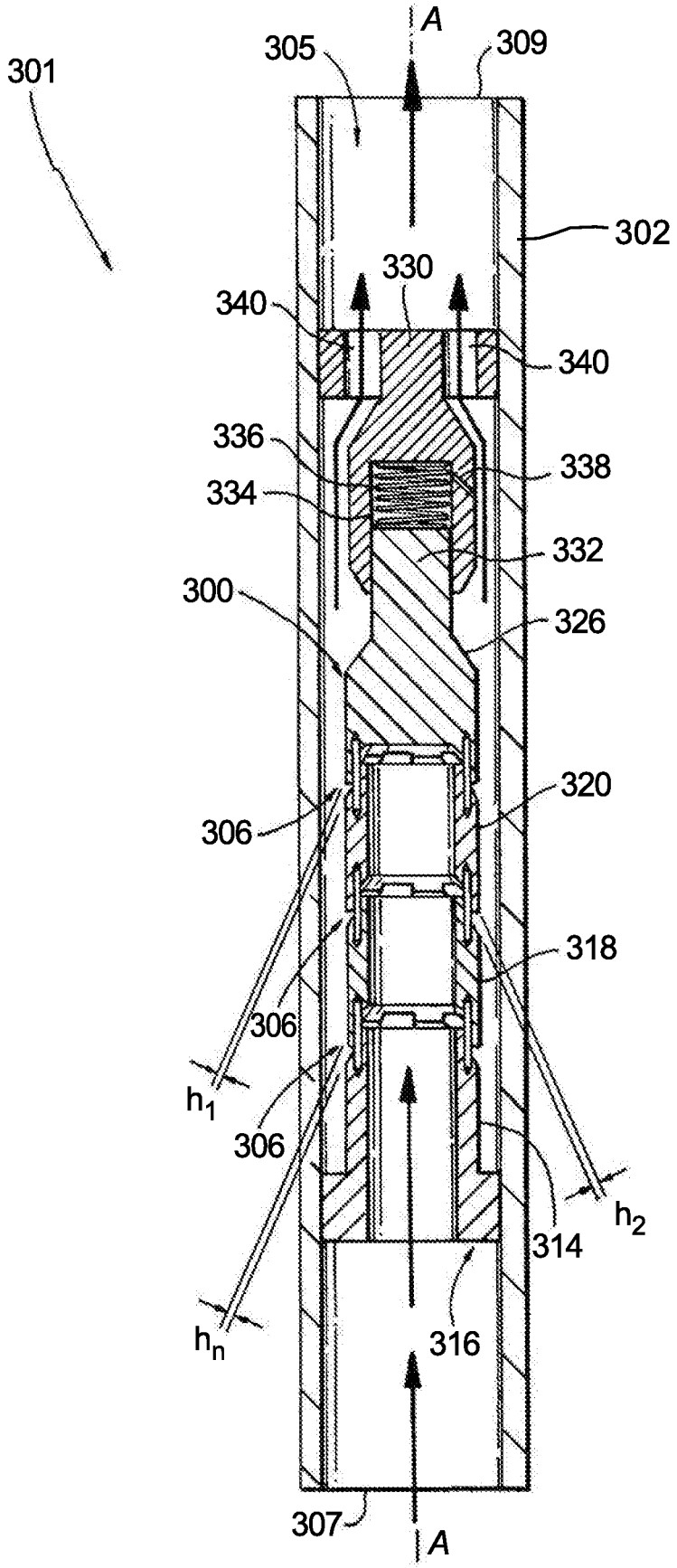
FIG. 23 is a cross-sectional side elevation view of the sand bridge inducer of FIG. 22, schematically showing upflow with the angled passageways at a minimal or reduced size for production flow conditions or for sand bridging.
Figure 24:
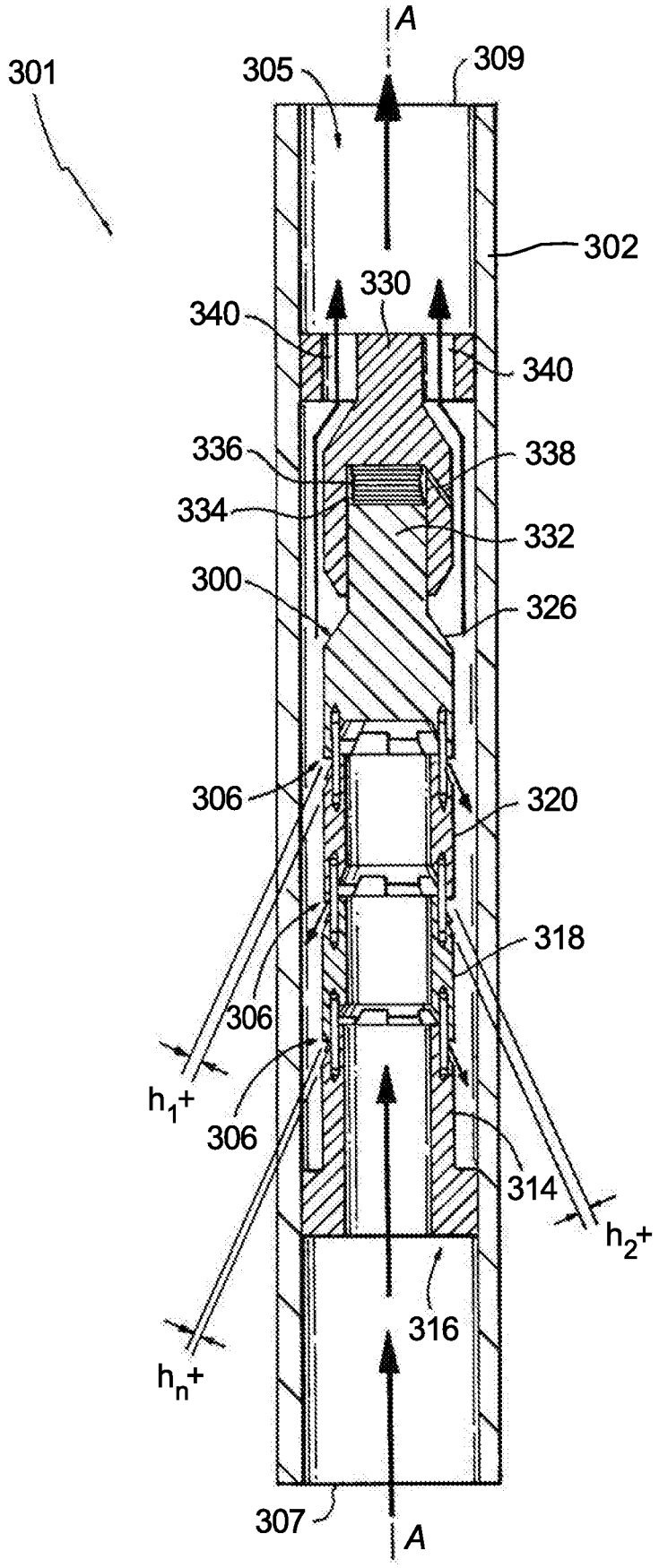
FIG. 24 is a cross-sectional side elevation view of the sand bridge inducer of FIG. 22, schematically showing upflow with the angled passageways at various increased sizes for accommodating passage of larger particles/solids and/or pressure differentials.
Figure 25:
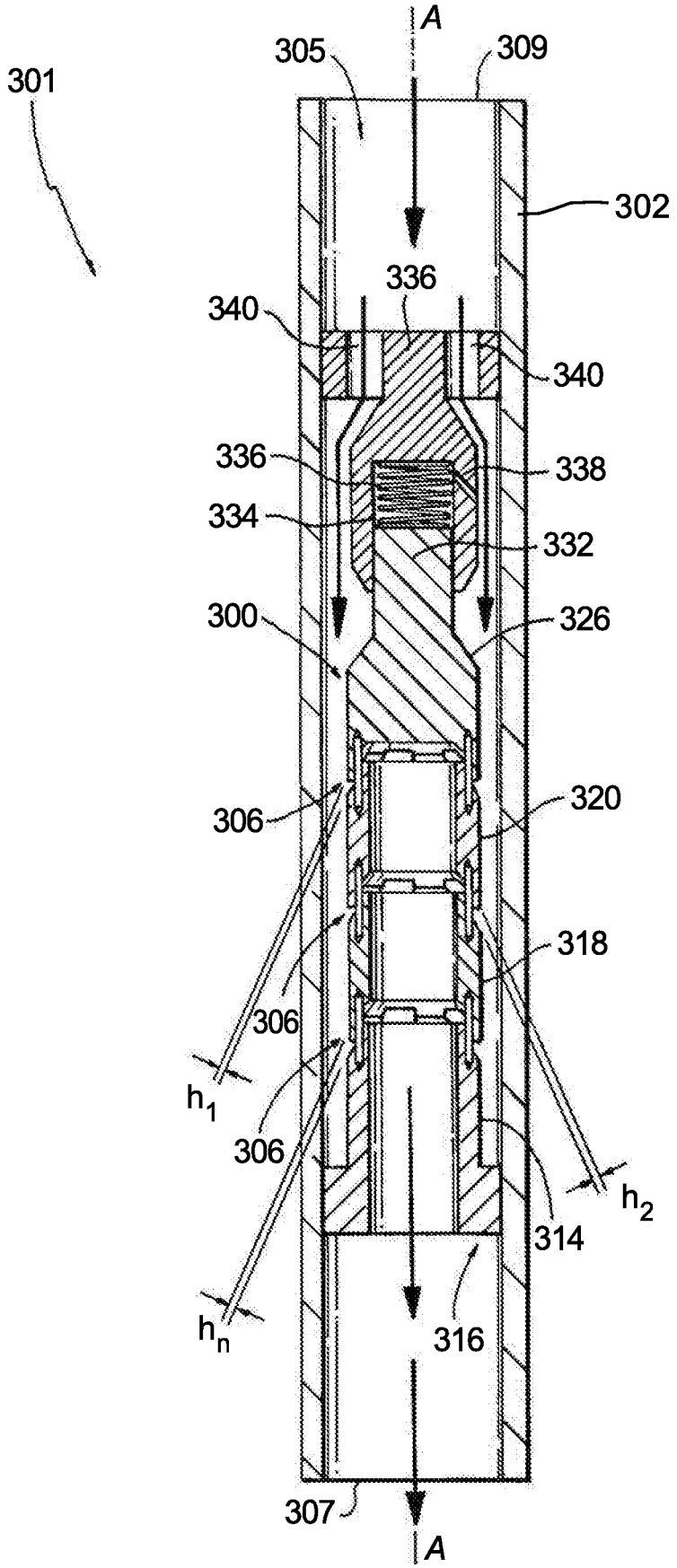
FIG. 25 is a cross-sectional side elevation view of the sand bridge inducer of FIG. 22, schematically showing downflow with the angled passageways at a minimal or reduced size for inducing sand bridges.

With reference now to FIG. 16, a downhole tool for sand fall-back prevention, e.g. in a string as described above, can include a sand bridge inducer 200 configured to be mounted in a flow path through a housing, e.g., housing 302 shown in FIGS. 23-25, of a downhole tool. The sand bridge inducer 200 defines a longitudinal axis A and has a main opening 204 therethrough, which forms an internal passage into the sand bridge inducer 200 and is closed off at one end by an end cap 205. The sand bridge inducer 200 includes one or more angled passageways 206 defined through a wall 208 of the sand bridge inducer 200 that are angled oblique relative to the longitudinal axis A such that the one or more angled passageways 206 open from a radially inward opening 210 and traverse axially downward linearly through the wall 208 toward a radially outward opening 212. It is also contemplated that angled passageways 206 can be angled horizontal relative to the longitudinal axis A. The angled passageways 206 can be aligned along an angle $\alpha$ of 45 degrees or greater relative to a horizontal plane P that is perpendicular to the longitudinal axis A of the sand bridge inducer 200. While the 45 degree upward angle $\alpha$ can be advantageous, those skilled in the art will readily appreciate that horizontal angle $\alpha$ and/or even a downward angle $\alpha$ may still provide for sand bridging without departing from the scope of this disclosure. For sake of clarity, only one of each opening 210 and 212 is labeled in FIG. 16. In the position shown in FIG. 16, the angled passageways 206 are precision passageways sized to promote a sand bridging effect therein without allowing sand to travel into the main opening 204 from above the sand bridge inducer 200.

The sand bridge inducer 200 is segmented with a respective upper segment and lower segment at each respective one of the one or more angled passageways 206. The respective upper and lower segments are connected to one another across the respective angled passageways 206 for movement along the longitudinal axis A relative to one another to enlarge the respective flow area of the angled passageway 206. This allows the angled passageways 206 to accommodate passage of larger particles and/or to relieve pressure differentials caused by high flow rates and/or solids restricting flow.

Figure 17:
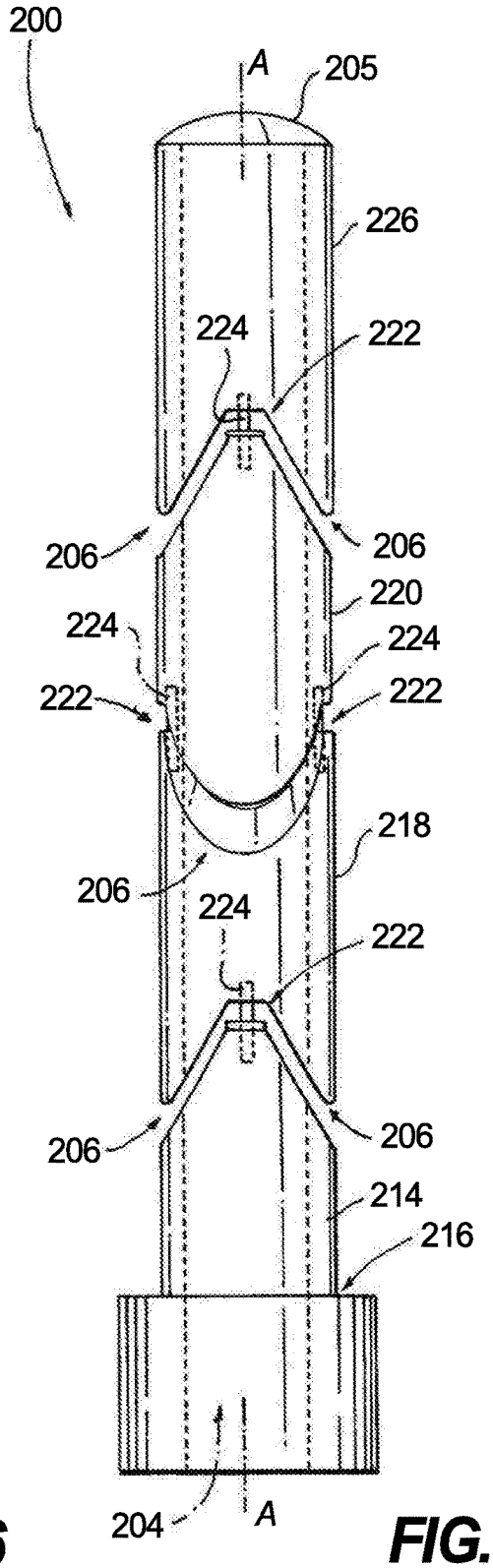

A lowermost segment 214 of the sand bridge inducer 200 defines a structural base 216 that is mounted against the housing, not shown in FIGS. 16-17 but see housing 302 in FIGS. 23-25. Base 216 prevents fall-back through the flow path past the lowermost segment 214 and the angled passageways 206 cause sand bridging to reduce and/or prevent fall-back through the angled passageways 206 into the main opening 204.

Sand bridge inducer 200 is segmented into four segments including a first segment that is a lower most segment 214 mounted to the housing (like segment 314 which is shown in FIGS. 23-25). A second segment 218 serves as an upper segment across a first one of the passageways 206, i.e. the lowest angled passageway 206 as oriented in FIGS. 16 and 17, from the lower most segment 214. Second segment 218 also serves as a lower segment across a second angled passageway 206, i.e. the middle angled passage 206 in FIGS. 16 and 17, across from a third segment 220 that is an upper segment across the second angled passageways 206 from the second segment 218. The third segment 220 serves as a lower segment across a third one of the angled passageways 206, namely the upper most angled passage 206 in FIGS. 16-17, from a fourth segment 226 that is an upper segment across the third angled passageways 206.

Each of the three angled passageways 206 is one of in a pair with a second respective angled access passageway 206 on the circumferentially opposite side of the sand bridge inducer 200, with an opposed pair of cheeks 222 separating between each of the angled passageways 206 in each pair. A respective sliding guide pin 224 in each cheek 220 slidingly engages the respective upper segment to the respective lower segment, i.e. there are two guide pins 224 between the segment 226 and the segment 220, two guide pins 224 between the segment 220 and the segment 218, and two guide pins between the segment 218 and the segment 214. The central pair of angled passageways 206 in FIGS. 16 and 17 is circumferentially rotated 90° relative to the upper and lower pairs of angled passageways 206. Those skilled in the art having the benefit of this disclosure will readily appreciate that the guide pins 224 are exemplary and that any other suitable number of pins or other method of locating or registering the segments 214, 218, 220, and 226 can be used, and that there are applications where guides or pins may be omitted without departing from the scope of this disclosure.

Each of the angled passageways 206 is planar along a plane P that is oblique to the longitudinal axis A, and the respective upper segment and lower segment for each angled passageway 206 meet at the respective cheek 222 at either end of the respective angled passageway 206 with the respective angled passageway 206 in the minimized position shown in FIG. 16. This arrangement allows the angled passageways 206 to widen from the minimized position shown in FIG. 16 to a position such as shown in FIG. 17 to accommodate pressure differentials, passage of solids, and/or passage of larger particles that are accommodated by the angled passageways 206 in their minimized position.

Figure 18:
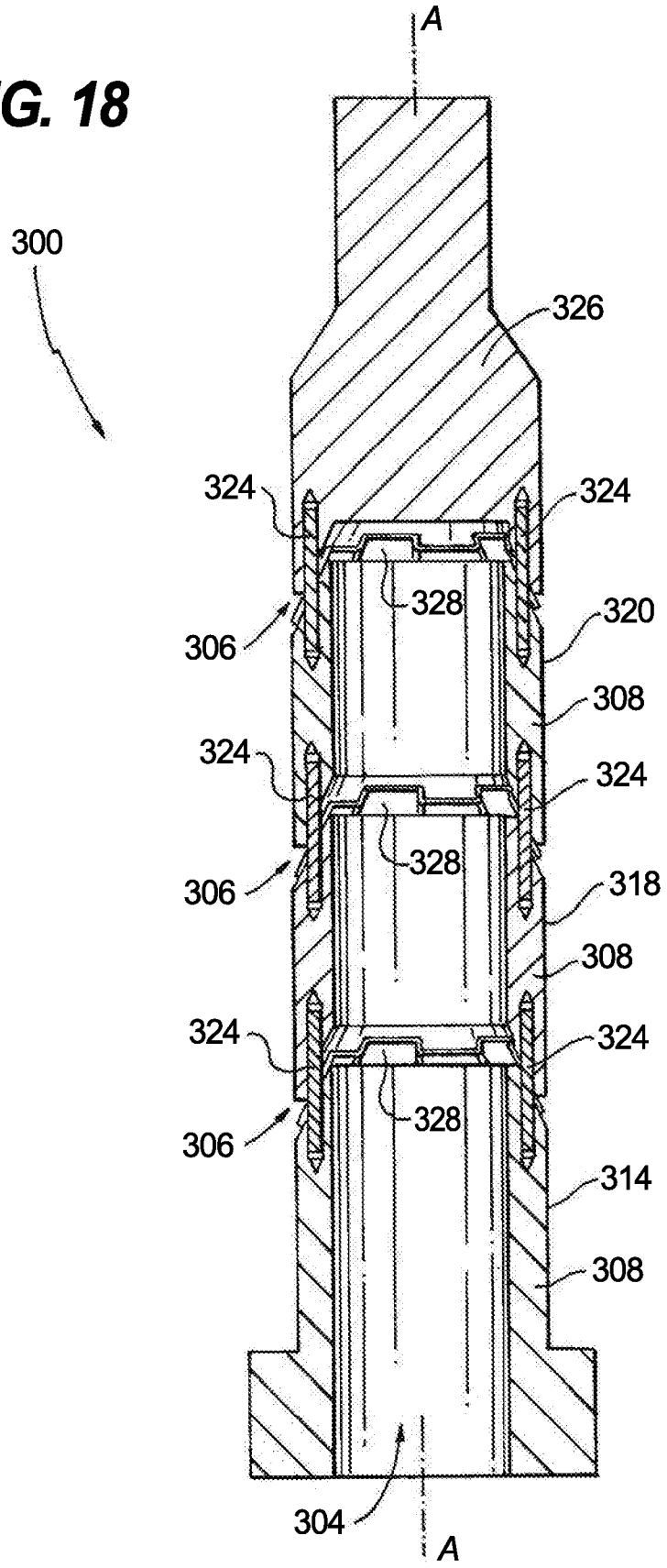
FIG. 18 is a cross-sectional side elevation view of an exemplary embodiment of a sand bridge inducer, showing angled passageways with respective conical ribbed washers maintaining spacing through the angled passageways.
Figure 19:
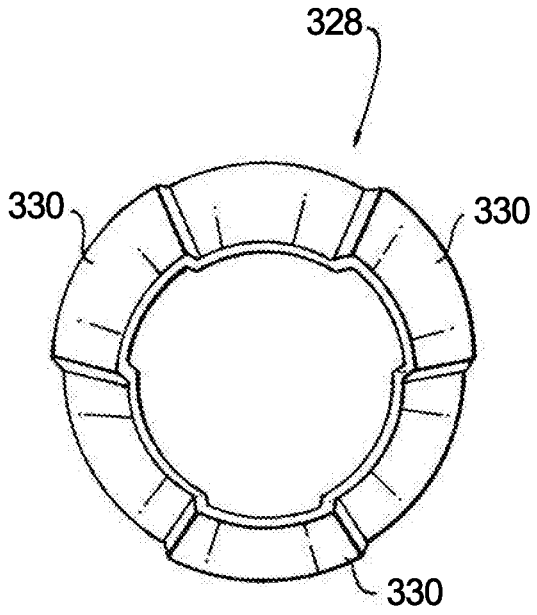
FIGS. 19-22 are respectively top plan, cross-sectional side elevation, bottom plan, and perspective views of one of the conical ribbed washers of FIG. 18, showing the ribs.
Figure 20:
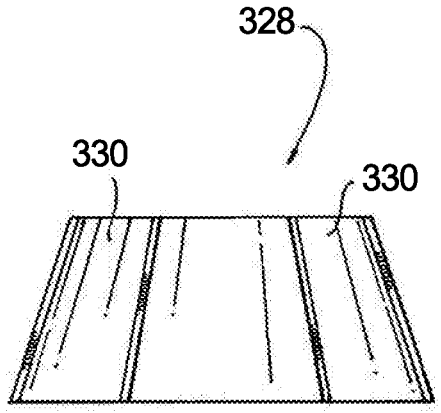
Figure 21:
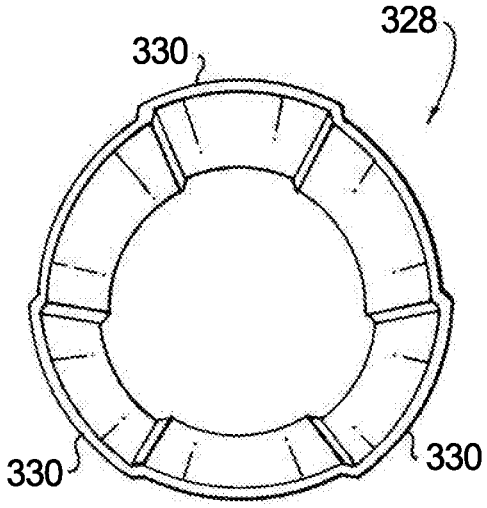
Figure 22:
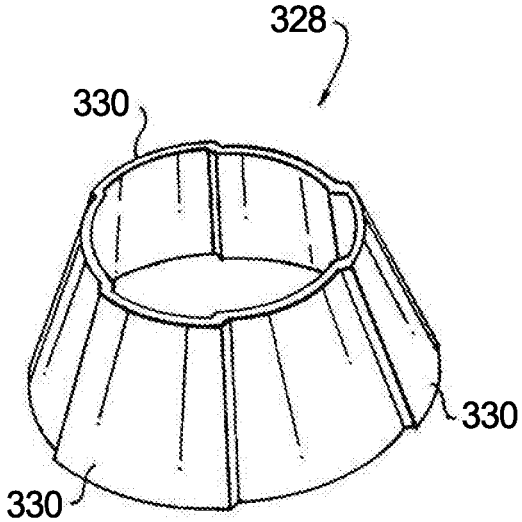

With reference now to FIG. 18, a sand bridge inducer 300 is shown that is segmented, like sand bridge inducer 200 described above, into four segments, a lower most first segment 314, a second segment 318, a third segment 320, and an uppermost fourth segment 326. Like sand bridge inducer 200 described above, sand bridge inducer 300 includes a main opening 304 and angled passageways 306 through the wall 308 of the sand bridge inducer 300. Like the sand bridge inducer 200 described above, the main opening 304 of the sand bridge inducer 300 is capped off by the upper most segment 326 so flow in through the main opening 304 (upward flow) must go out through the angled passageways 306 and flow in through the angled passageways 306 (downward flow) must go out through the main opening 304.

Each of the angled passageways 306 is defined between two respective ones of the segments 314, 318, 320, and 326. In sand bridge inducer 300, each of the angled passageways 306 is frustoconical, and extends circumferentially all the way around the sand bridge inducer 300 with respect to the longitudinal axis A, even when the angled passageway 306 is in a minimized position. While angled passageways 206 and 306 are planar and frustoconical, respectively, those skilled in the art with the benefit of this disclosure will readily appreciate that curved and/or non-linear passages can be used without departing from the scope of this disclosure. A pair of diametrically opposed guide pins 324 engages the respective upper and lower segments across each respective one of the angled passageways 306 much as described above with respect to guide pins 224, although as explained above, any suitable number of pins including zero can be used without departing from the scope of this disclosure.

A respective conical ribbed washer 328 is seated in each of the angled passageways 306 that spaces the respective upper and lower segments apart to maintain flow area through the respective angled passageway 306 in the minimized position. FIGS. 19-22 show various views of one of the conical ribbed washers 328 and the ribs 330 thereof. Those skilled in the art having the benefit of this disclosure will readily appreciate that the ribs of 330 in addition to or in lieu of being defined in conical ribbed washers 328 can be formed directly on the segments 314, 318, 320, and/or 326. Holes can be provided through the conical ribbed washers 328 to accommodate the guide pins 324, and the conical ribbed washers 328 can float on guide pins 324 during expansion of the angled passageways 306.

With reference now to FIG. 23, the downhole tool 301 includes a housing 303 defining a flow path 305 therethrough, where the flow arrows in FIG. 23 indicate upflow through the flow path, in an axial direction along the longitudinal axis A from a lower opening 307 in the housing 303 to an upper opening 309. The sand bridge inducer 300 is mounted in the flow path 305 of the housing 303 so fluid passing from the upper opening 309 to the lower opening 307 of the housing 302 or vice versa must pass through the one or more angled passageways 306.

The multiple precision flow paths 206 and 306 in each sand bridge inducer 200 and 300 share the respective flow and provide a cumulative flow area. Because the flow is shared, one flow path 206 or 306 becoming plugged is not detrimental. Also, because the flow can be shared among multiple flow paths 206 or 306, the flow dynamics can be appropriately managed.

The downhole tool 301 includes a guide 330 which can act as a protective upper chamber for the segments 314, 318, 320, and 326 in a similar capacity as upper chamber 124 described above even though the guide 330 only directly engages the upper most segment 326. The guide 330 is mounted in the flow path 305 of the housing 303, and the lower most one of the lower segments 314 is mounted at its structural base 316 stationary relative to the housing 303. The guide 330 is mounted stationary relative to the housing 303, and the upper most one of the upper segments 326 is engaged with the guide 330 for guided movement relative to the guide 330 along the longitudinal axis A. An upper end of the upper most segment 326 forms a piston 332 engaged with a piston chamber 334 of the guide 330. A biasing member 336 is seated between the guide 330 and the piston 332 for biasing the upper and lower segments 326, 320, and 318 downward. The guide 330 defines a weep hole 338 to allow pressure equalization and/or passage of fluids therethrough to accommodate displacement of the piston 332 within the guide 330. A screened port can be used in addition to or in lieu of the weep hole 338. The guide 330 can define one or more apertures 340 therethrough for passage of fluids through the flow path 305 of the housing 303. Those skilled in the art having had the benefit of this disclosure will readily appreciate that while sand bridge inducers 200 and 300 are depicted with four segments and three corresponding levels of angled passageways 206/306, any suitable number of angled passageways and/or segments, including one, two, or more, can be used without departing from the scope of this disclosure.

With continued reference to FIG. 23, a method of reducing or preventing sand fall-back in a downhole tool, e.g., the downhole tool 301, can include flowing production fluid upward through a flow path, e.g., the flow path 305 through a housing, e.g., housing 303, as indicated by the upward pointing flow arrows in FIG. 23. A sand bridge inducer, e.g. sand bridge inducer 200 or 300, is mounted in the flow path.

With reference to FIG. 24, the method can include widening at least one of the one or more angled passageways 206/306 while flowing production fluid upward through the flow path to accommodate passage of larger particles and/or relieve pressure differentials caused by high flow rates and/or solids restricting flow. Such conditions can arise, for example, due to dynamic flow conditions that may consist of widely varying amounts of solid particles, such as a sand slug, scale, residual polymer pieces, or fluid surges causing very high and intermittent flow rates. This widening is indicated by the opening heights h1, h2, and hn of the angled passageways 306 indicated in FIG. 23 as compared to the wider corresponding heights h1+, h2+, and hn+ for the same angled passageways 306 in FIG. 24. Note that it is not necessary for all of the angled passageways 306 to widen by the same amount, and the three angled passageways 306 are depicted in FIG. 24 with differing opening heights.

The biasing member 336 is compressed in FIG. 24 relative to in FIG. 23 due to the widening of the angled passageways 306. This allows flow surges or excessive solid particles to flow up through the flow path 305. After the condition that widens the angled passageways 306 ceases, the widening of the angled passageways 306 can be reversed, e.g., by the force of the biasing member 336 and/or weight of the segments 326, 320, and 318. This returns the sand bridge inducer 300 to the state shown in FIG. 23, e.g., with the height of the angled passageways 306 minimized but held open by the conical ribbed washers 328 identified in FIG. 18.

In the event that upward flow through the flow path 305 of the housing 303 in FIG. 25 ceases and/or reverse flow occurs, particles in particle laden fluid in the flow path 305 can form a respective sand bridge in each of the angled passageways 306 of the sand bridge inducer 300. Particles such as sand can be stalled around the base 316, but will be blocked from flowing to lower opening 307 of housing 303 due to the sand bridging in the angled passageways 306. The sand bridges form because particles must flow upward through the angled passageways 206/306, and this causes them to settle and form sand bridges blocking the angled passageways 206/306, preventing further particles from passing therethrough.

When upflow through the flow passage 305 resumes, downward flow out through the angled passageways 306, accompanied as needed by widening the angled passageways 306 as described above, clears the sand bridges and upward flow of production fluids can resume as shown in FIG. 23. This allows the angled passageways 206/306 to always be open even if they contain a sand bridge, and to enact a self-adjustment to widen as needed in conditions like those described above. While shown and described as expanding upward, those skilled in the art having the benefit of this disclosure will readily appreciate how to invert the sand bridge inducers 200/300 for downward expansion instead of upward expansion, without departing from the scope of this disclosure.

Sand bridge inducers 200 and 300 can provide advantages of dynamic, widening angled passageways 206/306. They also provide potential manufacturing advantages. For example, the angled passageways 206/306 can be formed as precision flow paths and then enhancements can be added to the angled passageways 206/306 such as hardened coatings. This is facilitated by separating the segments to provide direct line of sight to the surfaces of the angled passageways 206/306 during the coating process. In embodiments using conical ribbed washers (e.g., conical ribbed washers 328), if there is ever a need to adapt a sand bridge inducer design to have a different minimum height for the angled passageways 306, designers can implement this design change simply by changing the conical ribbed washers—the other components of the sand bridge inducer 300 need not necessarily be modified.

Accordingly, as set forth above, the embodiments disclosed herein may be implemented in a number of ways. For example, in general, in one aspect, the disclosed embodiments relate to a downhole tool for sand fall-back prevention. The downhole tool comprises, among other things, a housing defining a flow path therethrough in an axial direction from an upper opening to a lower opening. A poppet valve is mounted within the housing. The poppet valve includes an upper member defining an upper chamber mounted in the flow path so that flow through the flow path flows around the upper member, and a valve seat mounted in the flow path with an opening therethrough. A valve poppet is mounted for longitudinal movement within the flow path between a closed position in which the valve poppet seats against the valve seat to block flow through the flow path and an open position in which the valve poppet is spaced apart from the valve seat to permit flow through the flow path.

In general, in another aspect, the disclosed embodiments related to a method of reducing fall-back sand reaching an electrical submersible pump (ESP). The method comprises, among other things, holding a valve poppet in an open position by operating an ESP to drive flow through a flow path past the valve poppet, moving the valve poppet into a closed position blocking the flow path by reducing flow from the ESP, blocking sand through the flow path with the valve poppet, and preventing accumulation of sand above, e.g., directly above, the valve poppet while the valve poppet is in the closed position.

In accordance with any of the foregoing embodiments, in both the open and closed positions, the valve poppet can be at least partially within the upper chamber so that the upper chamber is always enclosed to prevent accumulation of fall-back sand above the valve poppet.

In accordance with any of the foregoing embodiments, a biasing member can be seated in the upper chamber biasing the valve poppet toward the valve seat.

In accordance with any of the foregoing embodiments, the upper member can include an upper surface with at least one angled portion that is angled to resist accumulation of sand on the upper surface.

In accordance with any of the foregoing embodiments, the valve poppet can be narrower than the upper chamber to allow movement of the valve poppet without resistance from fall-back sand or debris.

In accordance with any of the foregoing embodiments, the valve poppet can include an axially oriented perimeter surface matched in shape with an axially oriented interior surface of the upper chamber.

In accordance with any of the foregoing embodiments, a wiper seal or similar functioning seal can engage between the valve poppet and the upper member, wherein the seal is configured to allow passage of fluid while inhibiting passage of sand or debris.

In accordance with any of the foregoing embodiments, a weep hole can be defined through the upper member from a space outside the upper chamber to a space inside the upper chamber, wherein the weep hole is configured to equalize pressure between the space outside the upper chamber with the space inside the upper chamber. A filter material can be included within the weep hole.

In accordance with any of the foregoing embodiments, the valve seat can be defined by an angular surface configured to encourage wedging of sand during closing of the valve poppet against the valve seat.

In accordance with any of the foregoing embodiments, a poppet channel can be defined through the valve poppet for limited fluid communication through the flow path with the valve poppet in the closed position. The poppet channel can have a flow area equal to one-half of that through the flow path or greater. The poppet channel can include a tributary with an opening on a peripheral surface of the poppet valve, wherein the tributary of the poppet channel is directed downward toward the valve seat for initiating a buoyancy change in sand seated between the valve seat and the valve poppet prior to the valve poppet moving from the closed position to the open position. The tributary of the poppet channel can be defined along a tributary axis angled downward, e.g., 45° from level.

In accordance with any of the foregoing embodiments, the housing can include a head including the upper member and upper opening, a base including the lower opening and the valve seat, and a housing body mounted to the head and base, spacing the head and base apart axially.

In accordance with any of the foregoing embodiments, back flow can be allowed through a poppet channel defined through the valve poppet.

In accordance with any of the foregoing embodiments, initiating movement of the valve poppet from the closed position to an open position can be done by directing flow through a tributary of a poppet channel defined through the valve poppet, wherein the flow through the tributary is directed at sand accumulated between the valve poppet and an adjacent valve seat.

In accordance with any of the foregoing embodiments, increasing flow through the ESP can move the valve poppet into an open position for flow through the flow path, and accumulated fall-back sand can be discharged from a tool including the valve poppet in an upward direction.

In accordance with any of the foregoing embodiments, a downhole tool for sand fall-back prevention can include a housing defining a flow path therethrough in an axial direction from an upper opening to a lower opening, and a poppet valve mounted within the housing, wherein the poppet valve includes an upper member defining an upper chamber mounted in the flow path so that flow through the flow path flows around the upper member, a sand bridge inducer valve seat mounted in the flow path with a main opening therethrough, wherein the sand bridge inducer valve seat includes one or more angled passageways defined through a wall of the sand bridge inducer valve seat such that the one or more angled passageways open from a radially inward opening and traverse axially downward through the wall of the sand bridge inducer valve seat toward a radially outward opening, and a valve poppet mounted for longitudinal movement within the flow path between a closed position in which the valve poppet seats against the sand bridge inducer valve seat to block flow through the flow path and an open position in which the valve poppet is spaced apart from the valve seat to permit flow through the flow path.

In accordance with any of the foregoing embodiments, the one or more angled passageways can include one or more linear or curved passageways defined between a respective radially inward opening and radially outward opening.

In accordance with any of the foregoing embodiments, the one or more angled passageways can include one or more plate flow passageways including a rectangular cross-section.

In accordance with any of the foregoing embodiments, a cross-sectional area of the one or more plate flow passageways include a 10:1 width to gap ratio, and wherein the plate flow passageways include a depth to gap ratio of 20:1.

In accordance with any of the foregoing embodiments, at least one of the one or more angled passageways can be sized to promote a sand bridging effect therein without allowing sand to travel into the main opening.

In accordance with any of the foregoing embodiments, the one or more angled passageways can include at least two passageways of different flow area.

In accordance with any of the foregoing embodiments, a first passageway of the at least two passageways can have a smaller flow area than a second passageway, wherein the first passageway is disposed axially upward of the second passageway.

In accordance with any of the foregoing embodiments, the smaller first passageway can be sized to allow leak-off from downflow and the larger second passageways can be designed to allow sand bridging therein.

In accordance with any of the foregoing embodiments, the at least one of the angled passageways can include an angle of 45 degrees.

In accordance with any of the foregoing embodiments, the sand bridge inducer valve seat can include a top hat shape with a flow opening in a top thereof and a mounting flange axially opposed to the top, wherein an interface between the poppet and the sand bridge inducer valve seat can be at a top of the top hat shape.

In accordance with any of the foregoing embodiments, a sand bridge inducer for a downhole tool includes a wall defining a main opening therethrough and one or more angled passageways defined through the wall such that the one or more angled passageways open from a radially inward opening and traverse axially downward through the wall toward a radially outward opening.

In accordance with any of the foregoing embodiments, the one or more angled passageways can include one or more linear or curved passageways defined between a respective radially inward opening and radially outward opening.

In accordance with any of the foregoing embodiments, the one or more angled passageways can include one or more plate flow passageways including a rectangular cross-section.

In accordance with any of the foregoing embodiments, a cross-sectional area of the one or more plate flow passageways include a 10:1 width to gap ratio, and wherein the plate flow passageways include a depth to gap ratio of 20:1.

In accordance with any of the foregoing embodiments, at least one of the one or more angled passageways can be sized to promote a sand bridging effect therein without allowing sand to travel into the main opening.

In accordance with any of the foregoing embodiments, the one or more angled passageways can include at least two passageways of different flow area.

In accordance with any of the foregoing embodiments, a first passageway of the at least two passageways can have a smaller flow area than a second passageway, wherein the first passageway is disposed axially upward of the second passageway.

In accordance with any of the foregoing embodiments, the smaller first passageway can be sized to allow leak-off from downflow and the larger second passageways can be designed to allow sand bridging therein.

In accordance with any of the foregoing embodiments, the at least one of the angled passageways can include an angle of 45 degrees.

In accordance with any of the foregoing embodiments, the sand bridge inducer valve seat can include a top hat shape with a flow opening in a top thereof and a mounting flange axially opposed to the top, wherein an interface between the poppet and the sand bridge inducer valve seat can be at a top of the top hat shape.

In accordance with any of the foregoing embodiments, a downhole tool for sand fall-back prevention can include a sand bridge inducer configured to be mounted in a flow path through a housing of a downhole tool. The sand bridge inducer can define a longitudinal axis and having a main opening therethrough, wherein the sand bridge inducer includes one or more angled passageways defined through a wall of the sand bridge inducer that are oblique relative to the longitudinal axis such that the one or more angled passageways open from a radially inward opening and traverse axially downward through the wall of the sand bridge inducer toward a radially outward opening.

In accordance with any of the foregoing embodiments, the one or more angled passageways can include one or more linear passageways defined between a respective radially inward opening and radially outward opening.

In accordance with any of the foregoing embodiments, at least one of the one or more angled passageways can be sized to promote a sand bridging effect therein without allowing sand to travel into the main opening.

In accordance with any of the foregoing embodiments, the at least one of the angled passageways can be aligned along an angle of 45 degrees or greater relative to a horizontal plane perpendicular to the longitudinal axis of the sand bridge inducer.

In accordance with any of the foregoing embodiments, the downhole tool can include a housing defining a flow path therethrough in an axial direction along the longitudinal axis from a lower opening to an upper opening, wherein the sand bridge inducer is mounted in the flow path of the housing so fluid passing from the upper opening to the lower opening of the housing or vice versa must pass through the one or more angled passageways.

In accordance with any of the foregoing embodiments, the sand bridge inducer can be segmented with a respective upper segment and lower segment at each respective one of the one or more angled passageways, wherein the respective upper and lower segments are connected to one another across the respective angled passageway for movement along the longitudinal axis relative to one another to enlarge flow area of the respective angled passageway for accommodating passage of larger particles and/or relieving pressure differentials caused by high flow rates and/or solids restricting flow.

In accordance with any of the foregoing embodiments, the downhole tool can include a guide mounted in the flow path of the housing, wherein a lower most one of the lower segments is mounted stationary relative to the housing, wherein the guide is mounted stationary relative to the housing, and wherein an upper most one of the upper segments is engaged with the guide for guided movement relative to the guide along the longitudinal axis.

In accordance with any of the foregoing embodiments, the downhole tool can include a biasing member seated between the guide and the upper most one of the upper segments for biasing the upper and lower segments downward.

In accordance with any of the foregoing embodiments, the guide can define a weep hole and/or port to allow pressure equalization and/or passage of fluids therethrough to accommodate displacement of the upper most one of the upper segments as a piston within the guide.

In accordance with any of the foregoing embodiments, the downhole tool can include one or more sliding guide pins slidingly engaging each respective upper segment to the respective lower segment.

In accordance with any of the foregoing embodiments, each of the angled passageways can be frustoconical even when the angled passageway is in a minimized position.

In accordance with any of the foregoing embodiments, the downhole tool can include a respective conical ribbed washer spacing the respective upper and lower segments to maintain flow area through the respective angled passageway in the minimized position.

In accordance with any of the foregoing embodiments, each of the angled passageways can be planar along a plane oblique to the longitudinal axis, and the respective upper segment and lower segment can meet at a cheek at either end of the respective angled passageway with the respective angled passageway in the minimized position.

In accordance with any of the foregoing embodiments, a lowermost segment of the sand bridge inducer can define a base mounted against the housing for preventing fall-back through the flow path past the lowermost segment.

In accordance with any of the foregoing embodiments, the guide can define one or more apertures therethrough for passage of fluids through the flow path of the housing.

In accordance with any of the foregoing embodiments, the sand bridge inducer can be segmented into four segments including a first segment that is a lower most segment mounted to the housing, a second segment that is an upper segment across a first one of the one or more angled passageways from the first segment and that is a lower segment across a second one of the one or more angled passageways, a third segment that is an upper segment across the second one of the one or more angled passageways from the second segment and that is a lower segment across a third one of the one or more angled passageways, and a fourth segment that is an upper segment across the third one of the one or more angled passageways.

In accordance with any of the foregoing embodiments, a method of reducing or preventing sand fall-back in a downhole tool can include flowing production fluid upward through a flow path through a housing, wherein a sand bridge inducer is mounted in the flow path, wherein production fluid flows through one or more angled passageways through the sand bridge inducer, and forming a sand bridge in the one or more angled passageways of the sand bridge inducer upon cessation of production fluid flowing upward through the flow path.

In accordance with any of the foregoing embodiments, the method can include widening at least one of the one or more angled passageways while flowing production fluid upward through the flow path to accommodate passage of larger particles and/or relieve pressure differentials caused by high flow rates and/or solids restricting flow.

In accordance with any of the foregoing embodiments, the method can include reversing widening of the at least one of the one or more angled passageways after accommodating passage of larger particles and/or relieving pressure differentials.

The methods and systems of the present disclosure, as described above and shown in the drawings, provide for reduction or prevention of fall-back sand reaching an ESP with superior properties including accommodation for desirable back flow, extended useable life, and improved reliability relative to traditional systems and methods. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A downhole tool for sand fall-back prevention comprising:

a sand bridge inducer defining a longitudinal axis and having a main opening therethrough, wherein the sand bridge inducer includes one or more angled passageways defined through a wall of the sand bridge inducer that are oblique relative to the longitudinal axis such that the one or more angled passageways open from a radially inward opening and traverse axially downward through the wall of the sand bridge inducer toward a radially outward opening, and a housing defining a flow path therethrough in an axial direction along the longitudinal axis from a lower opening to an upper opening, wherein the sand bridge inducer is mounted in the flow path of the housing so fluid passing from the upper opening to the lower opening of the housing or vice versa must pass through the one or more angled passageways, wherein the sand bridge inducer is segmented with a respective upper segment and lower segment at each respective one of the one or more angled passageways, wherein the respective upper and lower segments are connected to one another across the respective angled passageway for movement along the longitudinal axis relative to one another to enlarge flow area of the respective angled passageway for accommodating passage of larger particles and/or relieving pressure differentials caused by high flow rates and/or solids restricting.

2. The downhole tool of claim 1, wherein the one or more angled passageways include one or more linear passageways defined between a respective radially inward opening and radially outward opening.

3. The downhole tool of claim 1, wherein at least one of the one or more angled passageways are sized to promote a sand bridging effect therein without allowing sand to travel into the main opening.

4. The downhole tool of claim 1, wherein the at least one of the angled passageways is aligned along an angle of 45 degrees or greater relative to a horizontal plane perpendicular to the longitudinal axis of the sand bridge inducer.

5. The downhole tool as recited in claim 1, further comprising a guide mounted in the flow path of the housing, wherein a lower most one of the lower segments is mounted stationary relative to the housing, wherein the guide is mounted stationary relative to the housing, and wherein an upper most one of the upper segments is engaged with the guide for guided movement relative to the guide along the longitudinal axis.

6. The downhole tool as recited in claim 5, further comprising a biasing member seated between the guide and the upper most one of the upper segments for biasing the upper and lower segments downward.

7. The downhole tool as recited in claim 5, wherein the guide defines a weep hole and/or port to allow pressure equalization and/or passage of fluids therethrough to accommodate displacement of the upper most one of the upper segments as a piston within the guide.

8. The downhole tool as recited in claim 5, wherein a lowermost segment of the sand bridge inducer defines a base mounted against the housing for preventing fall-back through the flow path past the lowermost segment.

9. The downhole tool as recited in claim 5, wherein the guide defines one or more apertures therethrough for passage of fluids through the flow path of the housing.

10. The downhole tool as recited in claim 1, further comprising one or more sliding guide pins slidingly engaging each respective upper segment to the respective lower segment.

11. The downhole tool as recited in claim 10, wherein each of the angled passageways is planar along a plane oblique to the longitudinal axis.

12. The downhole tool as recited in claim 11, wherein the respective upper segment and lower segment meet at a cheek at either end of the respective angled passageway with the respective angled passageway in the minimized position.

13. The downhole tool as recited in claim 1, wherein each of the angled passageways is frustoconical even when the angled passageway is in a minimized position.

14. The downhole tool as recited in claim 13, further comprising a respective conical ribbed washer spacing the respective upper and lower segments to maintain flow area through the respective angled passageway in the minimized position.

15. The downhole tool as recited in claim 1, wherein the sand bridge inducer is segmented into four segments including:

a first segment that is a lower most segment mounted to the housing;

a second segment that is an upper segment across a first one of the one or more angled passageways from the first segment and that is a lower segment across a second one of the one or more angled passageways;

a third segment that is an upper segment across the second one of the one or more angled passageways from the second segment and that is a lower segment across a third one of the one or more angled passageways; and a fourth segment that is an upper segment across the third one of the one or more angled passageways.

16. A method of reducing or preventing sand fall-back in a downhole tool comprising:

flowing production fluid upward through a flow path through a housing, wherein a sand bridge inducer is mounted in the flow path, wherein production fluid flows through one or more angled passageways through the sand bridge inducer, wherein the housing defines the flow path therethrough in an axial direction along a longitudinal axis from a lower opening to an upper opening, wherein the sand bridge inducer is mounted in the flow path of the housing so fluid passing from the upper opening to the lower opening of the housing or vice versa must pass through the one or more angled passageways, wherein the sand bridge inducer is segmented with a respective upper segment and lower segment at each respective one of the one or more angled passageways, wherein the respective upper and lower segments are connected to one another across the respective angled passageway for movement along the longitudinal axis relative to one another to enlarge flow area of the respective angled passageway for accommodating passage of larger particles and/or relieving pressure differentials caused by high flow rates and/or solids restricting; and forming a sand bridge in the one or more angled passageways of the sand bridge inducer upon cessation of production fluid flowing upward through the flow path.

17. The method as recited in claim 16, further comprising widening at least one of the one or more angled passageways while flowing production fluid upward through the flow path to accommodate passage of larger particles and/or relieve pressure differentials caused by high flow rates and/or solids restricting flow.

18. The method as recited in claim 17, further comprising reversing widening of the at least one of the one or more angled passageways after accommodating passage of larger particles and/or relieving pressure differentials.

* * * * *